US011430618B2

(12) United States Patent
Ohara et al.

(10) Patent No.: US 11,430,618 B2
(45) Date of Patent: Aug. 30, 2022

(54) PUSH SWITCH

(71) Applicant: ALPS ALPINE CO., LTD., Tokyo (JP)

(72) Inventors: Hiroshi Ohara, Miyagi (JP); Kenji Maemine, Tokyo (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/188,015

(22) Filed: Mar. 1, 2021

(65) Prior Publication Data

US 2021/0183593 A1 Jun. 17, 2021

Related U.S. Application Data

(63) Continuation of application No. PCT/JP2019/033862, filed on Aug. 29, 2019.

(30) Foreign Application Priority Data

Sep. 6, 2018 (JP) ..... JP2018-167073

(51) Int. Cl.
*H01H 13/48* (2006.01)
*H01H 13/14* (2006.01)
*H01H 13/52* (2006.01)

(52) U.S. Cl.
CPC ..... *H01H 13/48* (2013.01); *H01H 13/14* (2013.01); *H01H 13/52* (2013.01)

(58) Field of Classification Search
CPC ..... H01H 13/48; H01H 13/14; H01H 13/52; H01H 2237/004; H01H 2205/016; H01H 2221/05

(Continued)

(56) References Cited

U.S. PATENT DOCUMENTS 6,027,267 A * 2/2000 Yokobori ..... H01H 13/702 400/479
7,449,654 B2 * 11/2008 Tsuduki ..... G06F 3/0338 200/406

(Continued)

FOREIGN PATENT DOCUMENTS

EP 1968086 9/2008
JP S60-133440 U 9/1985

(Continued)

OTHER PUBLICATIONS

International Search Report for PCT/JP2019/033862 dated Nov. 19, 2019.

(Continued)

*Primary Examiner* — Lheiren Mae A Caroc
(74) *Attorney, Agent, or Firm* — IPUSA, PLLC

(57) ABSTRACT

A push switch includes a housing, a fixed contact member, a movable contact member, and a first pressing member. The housing includes an opening and a compartment, the movable contact member includes a dome that protrudes toward the opening and is invertible, and the first pressing member includes a first fulcrum portion, a first load portion, and a first effort portion. The first fulcrum portion is disposed on one side of the first pressing member to contact the housing, the first load portion is disposed on another side of the first pressing member to press the movable contact member, and the first effort portion is disposed between the first fulcrum portion and the first load portion. Upon the first effort portion being pressed through the opening, the first load portion presses and inverts the dome of the movable contact member, and the movable contact member contacts the fixed contact member.

8 Claims, 22 Drawing Sheets

(58) Field of Classification Search
USPC ..... 200/343
See application file for complete search history.

(56) References Cited

U.S. PATENT DOCUMENTS

| | | | | |
|---|---|---|---|---|
| 7,964,815 | B2 * | 6/2011 | Asada | H01H 15/102 200/406 |
| 2002/0027062 | A1 | 3/2002 | Shibutani et al. | |
| 2006/0037851 | A1 * | 2/2006 | Hu | H01H 15/102 200/406 |
| 2008/0029377 | A1 | 2/2008 | Tsuduki | |
| 2016/0049266 | A1 * | 2/2016 | Stringer | H01H 13/83 200/344 |
| 2016/0071665 | A1 * | 3/2016 | Watanabe | H01H 13/50 200/512 |

FOREIGN PATENT DOCUMENTS

| | | |
|---|---|---|
| JP | S62-157026 U | 10/1987 |
| JP | 2002-063830 | 2/2002 |
| JP | 2002-124153 | 4/2002 |
| JP | 2006-059820 | 3/2006 |
| JP | 2008-053067 | 3/2008 |
| JP | 2008-059962 | 3/2008 |
| JP | 2010-072096 | 4/2010 |
| JP | 2010-192410 | 9/2010 |
| JP | 2014-060107 | 4/2014 |
| JP | 6368041 | 8/2018 |

OTHER PUBLICATIONS

Office Action dated Feb. 1, 2022 issued with respect to the corresponding Japanese Patent Application No. 2020-541160.

* cited by examiner

PUSH SWITCH

CROSS-REFERENCE TO RELATED APPLICATIONS

This application is a continuation of International Application No. PCT/JP2019/033862, filed on Aug. 29, 2019 and designating the U.S., which claims priority to Japanese Patent Application No. 2018-167073 filed on Sep. 6, 2018. The contents of these applications are incorporated herein by reference in their entirety.

BACKGROUND OF THE INVENTION

1. Field of the Invention

The disclosures herein relate to a push switch.

2. Description of the Related Art

Conventionally, a push switch that includes an insulator having exposed contacts, an electrical contact member disposed on one of the contacts, and a pressing member disposed on the electrical contact member is known. In the above push switch, upon the pressing member being pressed, the electrical contact member deforms and contacts the other contacts, and as a result, the one contact is electrically connected to the other contacts. The electrical contact member is made by processing a metal plate obtained by forming a nickel plating layer on the surface of a thin plate-shaped substrate made of stainless steel, forming a copper plating layer on the nickel plating layer by flash plating, and then forming a silver plating layer on the copper plating layer (see Patent Document 1).

However, in the related art, in order to provide a short-stroke push switch, if the stroke of a dome-shaped movable contact is reduced, the distance between the movable contact and a fixed contact is decreased when the push switch is in an insulated state, that is, when the push switch is off. Therefore, the withstand voltage and insulation resistance may be reduced, thereby making it difficult to maintain the insulated state.

RELATED-ART DOCUMENTS

Patent Documents

Patent Document 1: Japanese Laid-Open Patent Publication No. 2006-059820

SUMMARY OF THE INVENTION

It is a general object of an embodiment of the present invention to provide a short-stroke push switch having electrical stability.

According to at least one embodiment, a push switch includes a housing, a fixed contact member, a movable contact member, and a first pressing member. The housing includes an opening and a compartment that communicates with the opening, the fixed contact member is attached to the housing and disposed within the compartment, the movable contact member is disposed closer to the opening than the fixed contact member within the compartment and includes a dome that protrudes toward the opening and that is invertible, and the first pressing member is disposed closer to the opening than the movable contact member within the compartment and includes a first fulcrum portion, a first load portion, and a first effort portion. The first fulcrum portion is disposed on one side of the first pressing member to contact the housing, the first load portion is disposed on another side of the first pressing member to press the movable contact member, and the first effort portion is disposed between the first fulcrum portion and the first load portion. Upon the first effort portion being pressed through the opening, the first load portion presses and inverts the dome of the movable contact member, and the movable contact member contacts the fixed contact member.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

According to at least one embodiment, a short-stroke push switch having electrical stability can be provided.

In the following, a push switch according to embodiments of the present invention will be described with reference to the accompanying drawings.

First Embodiment

Figure 1:
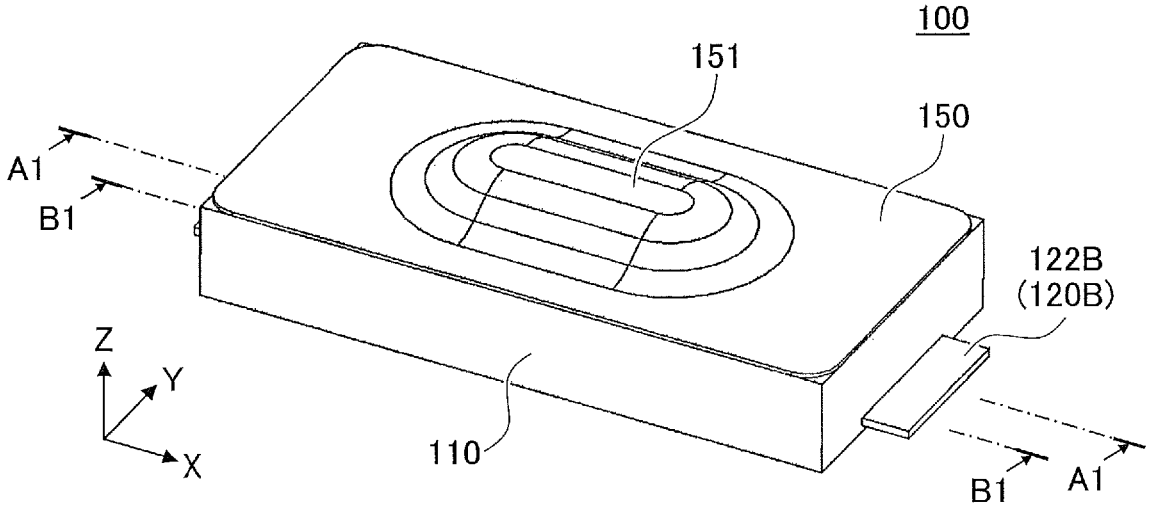
FIG. 1 is a perspective view of a push switch 100 according to a first embodiment.
Figure 2:
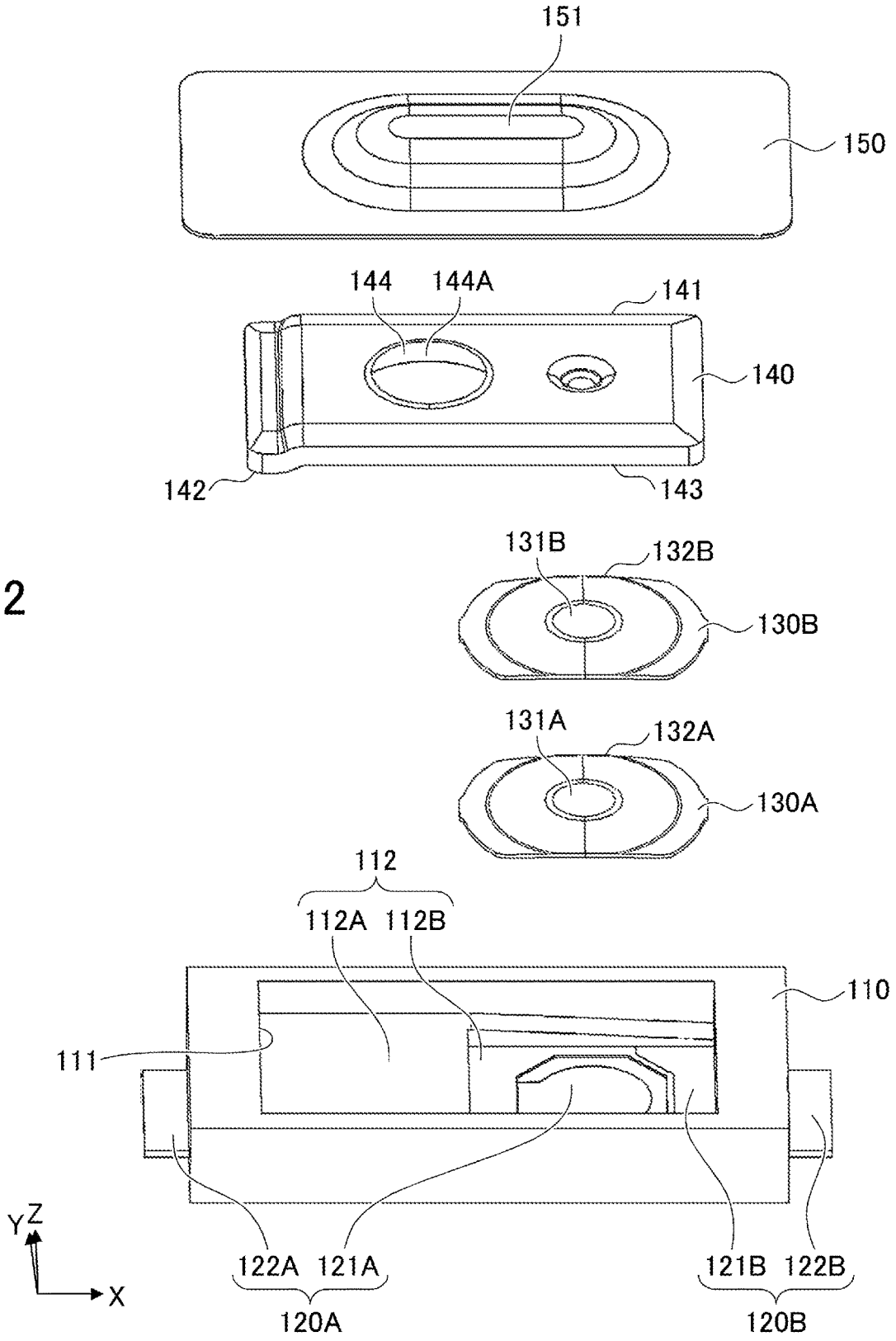
FIG. 2 is an exploded view of the push switch 100.

FIG. 1 is a perspective view of a push switch 100 according to a first embodiment. FIG. 2 is an exploded view of the push switch 100. In the following, an XYZ Cartesian coordinate system is used for description. Further, for convenience of description, the negative Z-side is referred to as a lower side or a lower part, and the positive Z-side is referred to as an upper side or an upper part, but this positional relationship does not represent a universal relationship.

The push switch 100 includes a housing 110, metal plates 120A and 120B, a metal contact 130A, a leaf spring 130B, a pressing member 140, and an insulator 150.

Figure 3:
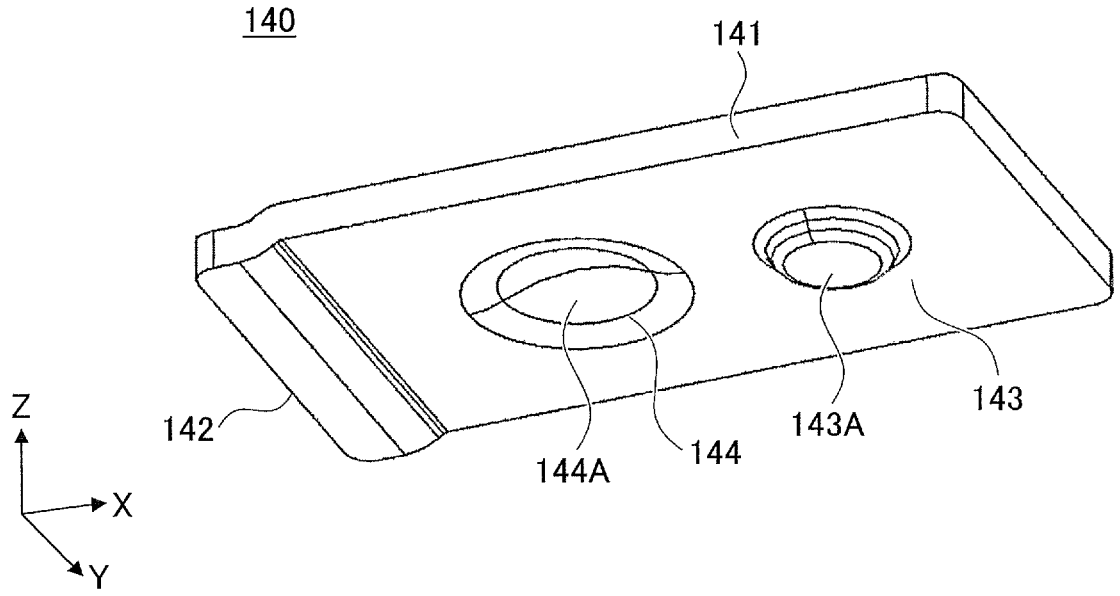
FIG. 3 is a diagram illustrating the back side of a pressing member 140.
Figure 4:
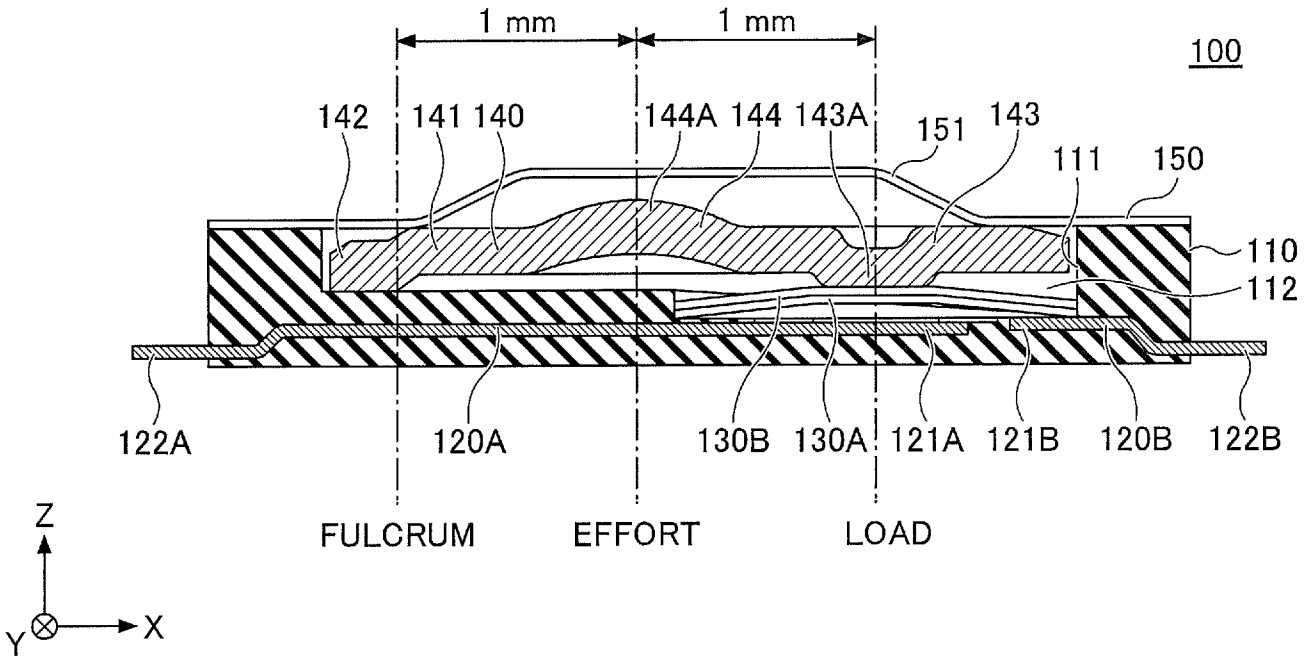
FIG. 4 is a cross-sectional view of the push switch 100 taken through A1-A1 of FIG. 1.
Figure 5:
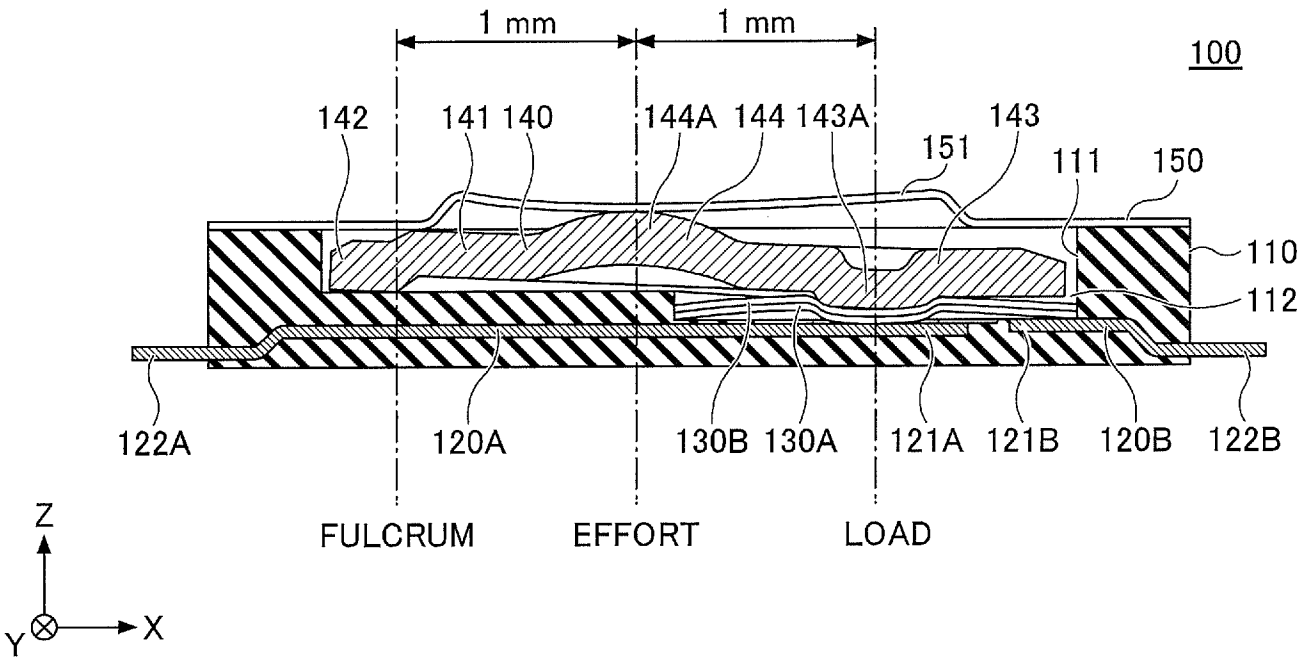
FIG. 5 is a cross-sectional view of the push switch 100 taken through B1-B1 of FIG. 1.

In the following, the pressing member 140 will be described with reference to FIG. 2 and FIG. 3. FIG. 3 is a diagram illustrating the back side of the pressing member 140. Further, a cross-sectional structure will be described with reference to FIG. 4 and FIG. 5. FIG. 4 is a cross-sectional view of the push switch 100 taken through A1-A1 of FIG. 1. FIG. 5 is a cross-sectional view of the push switch 100 taken through B1-B1 of FIG. 1.

When the contact 130A is off (in an electrically disconnected state), the metal contact 130A contacts the metal plate 120B (a peripheral fixed contact 121B), and does not contact the metal plate 120A (a central fixed contact 121A). That is, the metal plate 120A is not electrically connected to the metal plate 120B. Pressing the insulator 150 down causes the metal contact 130A to be pressed down through the pressing member 140 and the leaf spring 130B. As a result, the metal contact 130A becomes inverted and contacts the metal plate 120A, thus causing the metal plate 120A to be electrically connected to the metal plate 120B through the metal contact 130A, and in this state, the push switch 100 is on (in an electrically connected state). A stroke for pressing the insulator 150 in order to cause the metal contact 130A to contact the metal plate 120A is 0.05 mm, which is very short. Further, an operating load required to invert the metal contact 130A is 3.3 N, for example. This operating load is sufficient to prevent the push switch 100 from being turned on if the insulator 150 is accidentally touched. That is, this operating load is sufficient to reduce misoperation.

The housing 110 is made of resin, and holds the metal plates 120A and 120B. The housing 110 and the metal plates 120A and 120B are integrally formed by insert molding. The housing 110 has an opening 111 and a compartment 112 that communicates with the opening 111. The opening 111 is formed on the surface on the positive Z-side of the housing 110.

The compartment 112 extends downward from the opening 111, and includes a compartment 112A on the negative X-side and a compartment 112B on the positive X-side. The compartment 112B is deeper than the compartment 112A, and the bottom surfaces of the compartment 112A and the compartment 112B are stepped.

The central fixed contact 121A of the metal plate 120A and the peripheral fixed contact 121B of the metal plate 120B are disposed at the bottom of the compartment 112B, and are exposed in the compartment 112B. The leaf spring 130B is stacked on the metal contact 130A, and the metal contact 130A and the leaf spring 130B are disposed above the central fixed contact 121A and the peripheral fixed contact 121B within the compartment 112B (see FIG. 4). The pressing member 140 is disposed on the leaf spring 130B, and is housed over the compartments 112A and 112B.

The metal plate 120A includes the central fixed contact 121A and a terminal 122A. For example, the metal plate 120A may be made of copper. The central fixed contact 121A does not contact the metal contact 130A when the insulator 150 is not pressed down (see FIG. 4), and contacts the metal contact 130A when the insulator 150 is being pressed down (see FIG. 5). The terminal 122A protrudes to the negative X-side of the housing 110.

The metal plate 120B includes the peripheral fixed contact 121B and a terminal 122B. For example, the metal plate 120B may be made of copper. The peripheral fixed contact 121B contacts the end portion on the positive X-side of the metal contact 130A when the insulator 150 is not pressed down (see FIG. 4), and contacts the metal contact 130A also when the insulator 150 is being pressed down (see FIG. 5). The terminal 122B protrudes to the positive X-side of the housing 110.

The metal contact 130A is a metal spring, and includes a dome 131A at the center thereof (see FIG. 2 and FIG. 4). The metal contact 130A protrudes upward in a dome shape and is invertible. The metal contact 130A is an example of a movable contact member. For example, the metal contact 130A may be made of stainless steel.

The dome 131A is inverted and projects downward upon being pressed from the top (see FIG. 5.) In this state, the metal contact 130A contacts the central fixed contact 121A, thereby causing the central fixed contact 121A to be electrically connected to the peripheral fixed contact 121B. The lower surface of the metal contact 130A is silver-plated. This is because the lower surface of the metal contact 130A contacts the central fixed contact 121A and the peripheral fixed contact 121B through which the current flows. In addition, the inversion of the dome 131A can provide an operating sensation to an operator.

The metal contact 130A is made by punching a metal plate having a circular shape in plan view to form the dome 131A, and cutting portions on the positive Y-side and on the negative Y-side of the metal plate along the X-axis. Therefore, the metal contact 130A includes cut portions 132A on the positive Y-side and the negative Y-side. The cut portions 132A are formed in order to reduce the size of the push switch 100 in the Y-axis direction.

The leaf spring 130B has the same configuration as that of the metal contact 130A, except that silver plating is not applied to the leaf spring 130B. The leaf spring 130B includes a dome 131B and cut portions 132B.

The pressing member 140 is housed over the compartments 112A and 112B of the compartment 112 (see FIG. 4). The pressing member 140 is an example of a first pressing member. The pressing member 140 is a metal member having a flat plate shape (see FIGS. 2, 3, and 4). The pressing member 140 includes a body portion 141, a fulcrum portion 142 (an example of a first fulcrum portion), a load portion 143 (an example of a first load portion), and an effort portion 144 (an example of a first effort portion). The pressing member 140 can function as a lever, and the fulcrum portion 142, the load portion 143, and the effort portion 144 function as the fulcrum, load, and effort of a lever. The pressing member 140 may be made by processing a metal plate. For example, the pressing member 140 may be made of stainless steel.

Because the pressing member 140 utilizes the principle of leverage, the pressing member 140 needs to have low deflection and relatively high stiffness. For this reason, the pressing member 140 is composed of metal, and is relatively wide in the Y-axis direction and relatively thick in the Z-axis direction.

The body portion 141 has a shape in which the fulcrum portion 142 and the load portion 143 are curved downward with respect to the effort portion 144 such that the load portion 143 can be easily displaced downward.

The fulcrum portion 142 is disposed on the negative X-side and contacts the bottom surface of the compartment 112A. The width in the Y-axis direction of the fulcrum portion 142 is sufficiently large. Therefore, the fulcrum portion 142 is not readily tilted in the Y-axis direction when the pressing member 140 is moved, thereby allowing a force to be efficiently transmitted to the leaf spring 130B and the metal contact 130A. In the present embodiment, the fulcrum portion 142 is disposed on the entire side in the Y-axis direction of the pressing member 140, but the fulcrum portion 142 may be divided into several portions.

The fulcrum portion 142 protrudes in the negative Z-direction. Causing the fulcrum portion 142 to protrude in the negative Z-side allows the pressing member 140 to be located away from the bottom surface of the compartment 112 in the positive Z-side. Accordingly, the pressing member 140 can be readily moved.

The load portion 143 is disposed on the positive X-side, and includes a projection 143A (an example of a first projection) configured to press the metal contact 130A. As illustrated in FIG. 3, the projection 143A has a truncated cone shape and a flat lower surface, and further, the projection 143A has a circular shape in plan view.

The projection 143A is disposed in contact with the upper surface of the leaf spring 130B. The pressing member 140 utilizes the principle of leverage to cause the load portion 143 to be pressed down, thereby pressing the leaf spring 130B and the metal contact 130A down. As a result, the leaf spring 130B and the metal contact 130A are inverted, and the metal contact 130A contacts the central fixed contact 121A.

The effort portion 144 is disposed between the fulcrum portion 142 and the load portion 143, and includes a projection 144A. The projection 144A protrudes upward in a hemispherical shape. When the insulator 150 is not pressed, the insulator 150 does not contact the projection 144A, and there is a space between the projection 144A and the insulator 150. Upon the insulator 150 being pressed down, the insulator 150 contacts the projection 144A and presses the projection 144A down. In this state, the force is applied to the effort of the pressing member 140 that utilizes the principle of leverage.

The insulator 150 is made of a resin sheet, is bonded to the upper surface of the housing 110, and covers the opening 111. The insulator 150 includes a protrusion 151 at the center thereof in plan view (see FIG. 1, FIG. 2, and FIG. 4). The protrusion 151 is formed by heating the resin sheet.

The metal plates 120A and 120B, the metal contact 130A, the leaf spring 130B, and the pressing member 140 are housed in the compartment 112 of the housing 110, and the insulator 150 is bonded to the housing 110. By bonding the insulator 150 to the housing 110, the metal plates 120A and 120B, the metal contact 130A, the leaf spring 130B, and the pressing member 140 can be held in the compartment 112 without looseness.

The protrusion 151 is disposed at a position that overlaps with the effort portion 144 in plan view, and is deflectable and deformable so as to contact the effort portion 144 (see FIG. 5). When the protrusion 151 is not deflected and deformed as illustrated in FIG. 4, the protrusion 151 is spaced apart from the effort portion 144.

Figure 6:
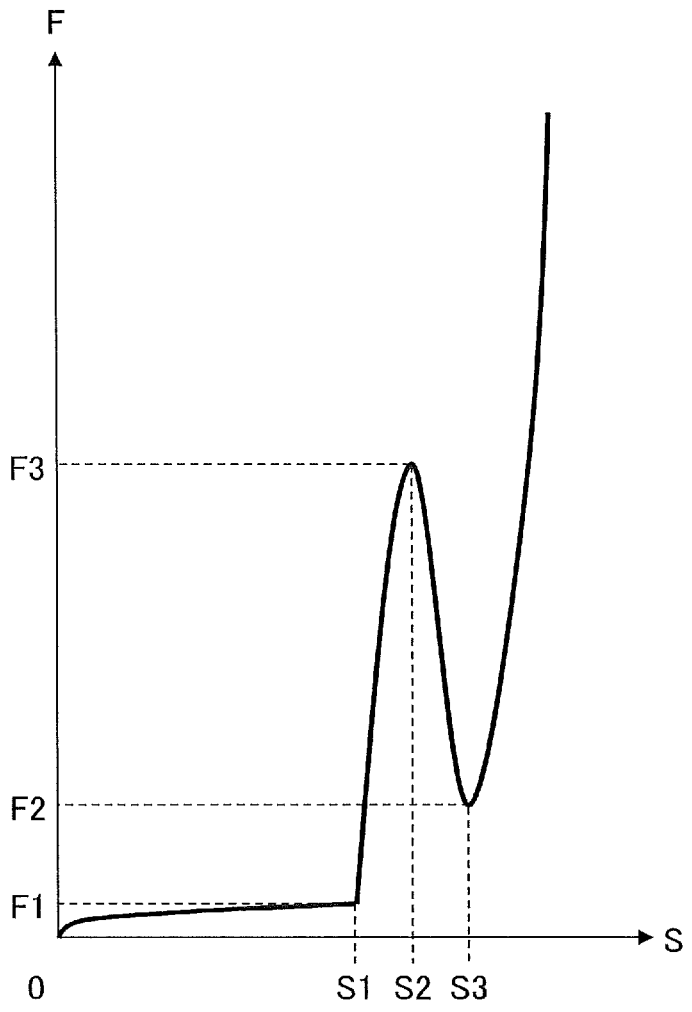
FIG. 6 is a graph indicating force-stroke (FS) characteristics of the push switch 100.

FIG. 6 is a graph indicating force-stroke (FS) characteristics of the push switch 100. The horizontal axis represents a stroke (S) for pressing the insulator 150 down, and the vertical axis represents a force (F) required to press the insulator 150 down. The force (F) corresponds to the operating load.

As illustrated in FIG. 6, when the insulator 150 is pressed down from a zero-stroke position, the operating load gradually increases until reaching S1. During this time, the operating load is very small. This indicates that the operating load required to press the insulator 150 is very small.

S1 is 0.1 mm. The push switch 100 may include a button on the insulator 150. The button may be a push button switch used in a vehicle, a push-button switch used in an electronic device, or any button that is actually pressed.

For example, in the case of a product that is easily subjected to vibrations, such as a portable device, if there is a gap between an insulator and a button, a vibration applied to the product would be transmitted to the button, and as a result, noise would be generated. In such a case, the noise may be reduced by pressing the button against another component while the product is not in operation. For example, the button may be attached to the insulator while slightly pressing (pre-tensioning) the insulator so as to avoid a gap between the button and the insulator. In this state, the insulator is being pressed by the stroke S1 or less. In this case, when the button is pressed, the stroke may start from S1.

Upon the stroke reaching S1, the insulator 150 contacts the projection 144A of the effort portion 144. Upon the stroke exceeding S1, the pressing member 140 presses the metal contact 130A and the leaf spring 130B. Upon the stroke reaching S2, the operating load becomes F3 (a local maximum), and the metal contact 130A and the leaf spring 130B are inverted. At this time, the operating load starts to rapidly decrease, and thus a clicking sensation is provided to the user's finger. Pressing the insulator 150 further causes the stroke to reach S3 and the operating load to be decreased to F2. At this time, the metal contact 130A contacts the central fixed contact 121A, thereby causing the push switch 100 to be turned on.

As illustrated in FIG. 4 and FIG. 5, in the push switch 100, in order to utilize the principle of leverage, the distance between the fulcrum portion 142 and the load portion 143 may be set to 1 mm, and the distance between the load portion 143 and the effort portion 144 may be set to 1 mm, for example.

Therefore, a stroke for pressing the insulator 150 in order to turn the push switch 100 on is half a stroke for pressing and inverting the metal contact 130A and the leaf spring 130B alone. As used herein, pressing the metal contact 130A and the leaf spring 130B alone means pressing the metal contact 130A and the leaf spring 130B directly.

Further, an operating load required to press the insulator 150 in order to turn the push switch 100 on is twice an operating load required to press and invert the metal contact 130A and the leaf spring 130B alone.

Note that a stroke for pressing and inverting the metal contact 130A alone is 0.1 mm. This stroke is the same as the stroke for pressing and inverting the metal contact 130A and the leaf spring 130B that are stacked.

When the push switch 100 is off, the metal contact 130A is not connected to the central fixed contact 121A, and remains insulated from the central fixed contact 121A. In this state, the distance between the central fixed contact 121A and the metal contact 130A is 0.1 mm. It is known that the metal contact 130A can remain insulated from the central fixed contact 121A when the distance between the central fixed contact 121A and the metal contact 130A is 0.1 mm. Upon the metal contact 130A and the leaf spring 130B being inverted and moved down by 0.1 mm, the metal contact 130A contacts the central fixed contact 121A.

As described above, the stroke for pressing the insulator 150 in order to turn the push switch 100 on is half the stroke for pressing and inverting the metal contact 130A and the leaf spring 130B alone. Therefore, the stroke for pressing the insulator 150 in order to turn the push switch 100 on is 0.05 mm.

That is, in the push switch 100 according to the first embodiment, the stroke required for the push switch 100 can be reduced by utilizing the principle of leverage, without reducing the stroke of the metal contact 130A and of the leaf spring 130B.

Conversely, if the principle of leverage is not utilized and the stroke for pressing and converting the metal contact 130A is set to 0.05 mm, the distance between the central fixed contact 121A and the metal contact 130A would be set to 0.05 mm when the push switch 100 is off. With this configuration, the withstand voltage and insulation resistance would be reduced, thus making it difficult to maintain the insulation between the central fixed contact 121A and the metal contact 130A.

Further, if the stroke of the metal contact 130A is set to 0.05 mm, the insulator 150 would be difficult to be pretensioned.

In the first embodiment, the operating load required to press the insulator 150 in order to turn the push switch 100 on is twice the operating load required to press and invert the metal contact 130A and the leaf spring 130B alone. Accordingly, a clicking sensation during the operation of the push switch 100 can be made twice.

Accordingly, in the first embodiment, the short-stroke push switch 100 having electrical stability can be provided. Further, a clicking sensation during operation can be increased, thus improving an operating sensation.

In addition, by utilizing the principle of leverage, the operating load required for the push switch 100 can be readily obtained if a metal contact and a leaf spring with low operating loads are used. In general, a metal contact with a high operating load tends to have a longer operating life than a metal contact with a low operating load. That is, the operating life of the push switch 100 can be extended.

Further, in the present embodiment, the leaf spring 130B is stacked on the metal contact 130A in order to obtain a predetermined operating load. However, if a required operating load is low, the number of stacked parts may be reduced (that is, the leaf spring 130B is not required to be provided).

Further, the pressing member 140 can be made by stamping a metal plate. Therefore, the components such as the fulcrum portion 142, the load portion 143, and the effort portion 144 can be readily formed.

In the above-described embodiment, the distance between the fulcrum portion 142 and the load portion 143 is set to 1 mm and the distance between the load portion 143 and the effort portion 144 is set to 1 mm. However, these distances can be adjusted, and the stroke and the pressing load of the insulator 150 can be freely set by adjusting these distances.

Further, in the above-described embodiment, the push switch 100 includes the metal contact 130A and the leaf spring 130B, but the push switch 100 may include the metal contact 130A only.

Further, in the above-described embodiment, the pressing member 140 includes the projection 143A and the projection 144A, but the pressing member 140 does not necessarily include one or both of the projection 143A and the projection 144A.

Second Embodiment

Figure 7:
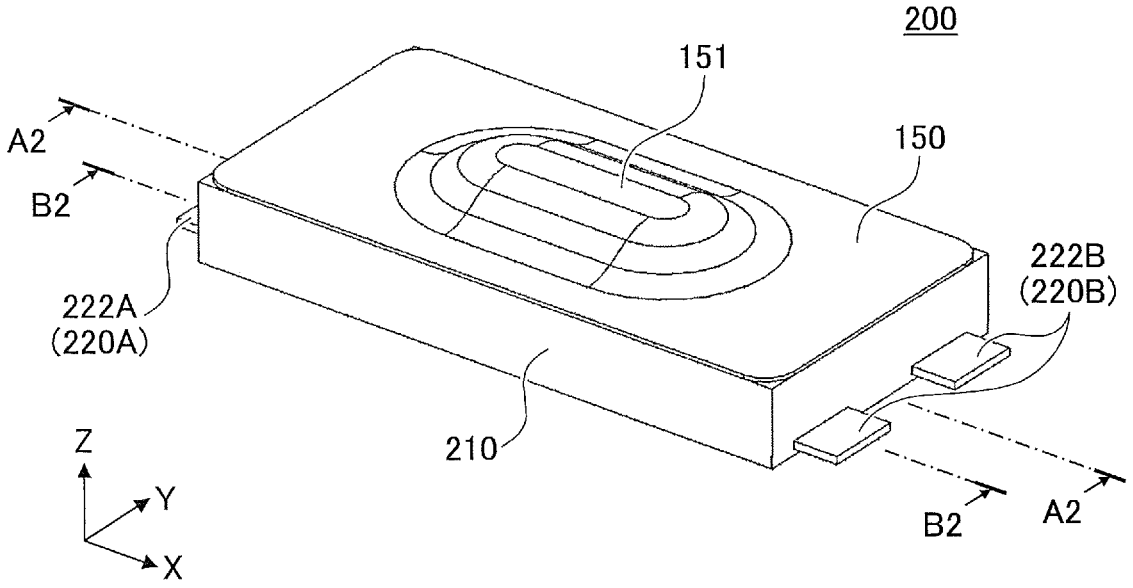
FIG. 7 is a perspective view of a push switch 200 according to a second embodiment.
Figure 8:
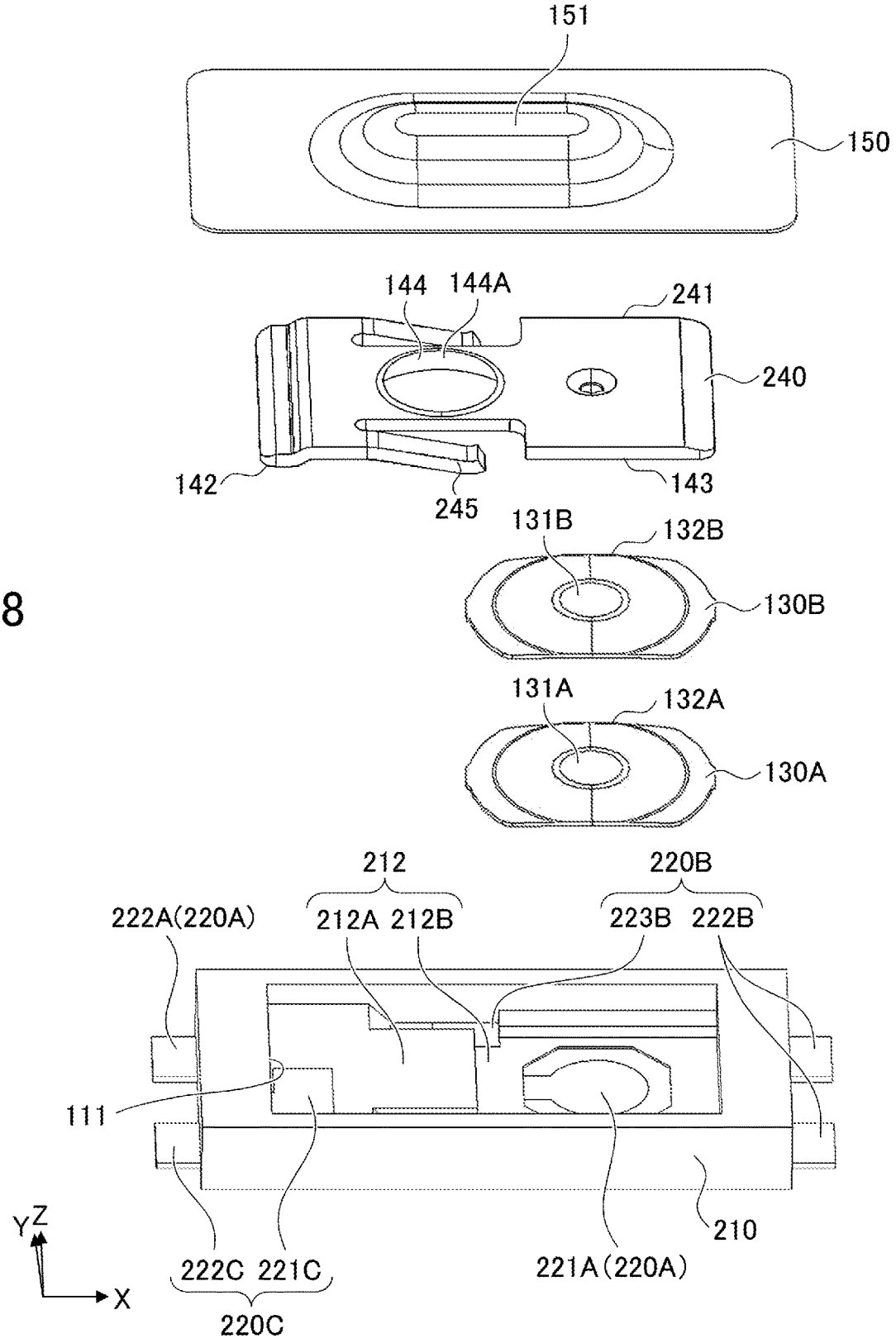
FIG. 8 is an exploded view of the push switch 200.

FIG. 7 is a perspective view of a push switch 200 according to a second embodiment. FIG. 8 is an exploded view of the push switch 200.

The push switch 200 includes a housing 210, metal plates 220A, 220B, and 220C, a metal contact 130A, a leaf spring 130B, and an insulator 150.

Figure 9:
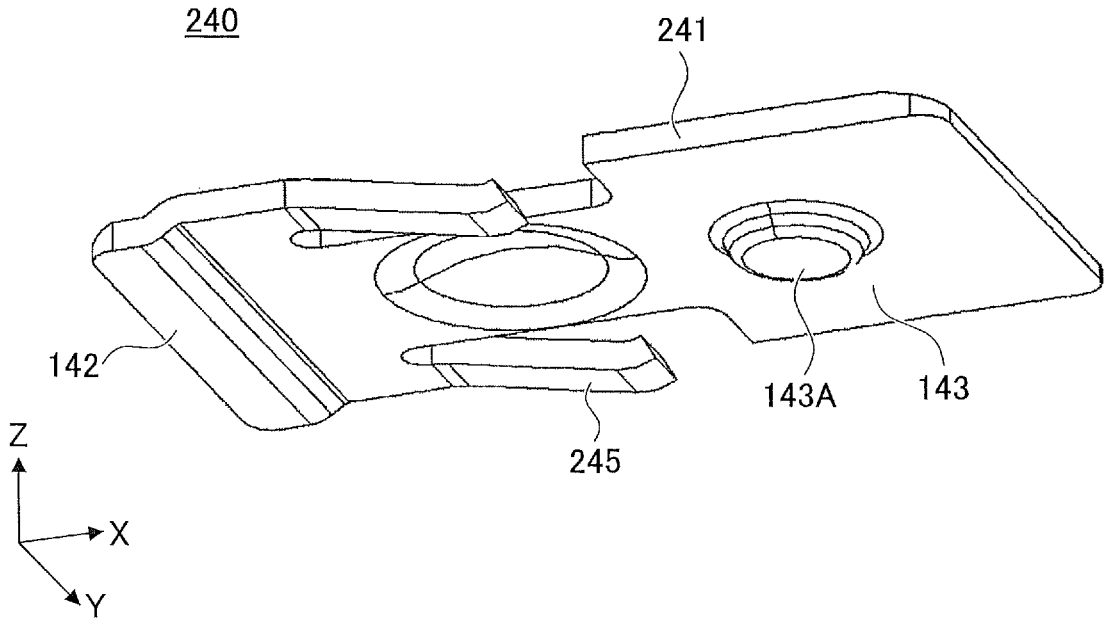
FIG. 9 is a diagram illustrating the back side of a pressing member 240.
Figure 10:
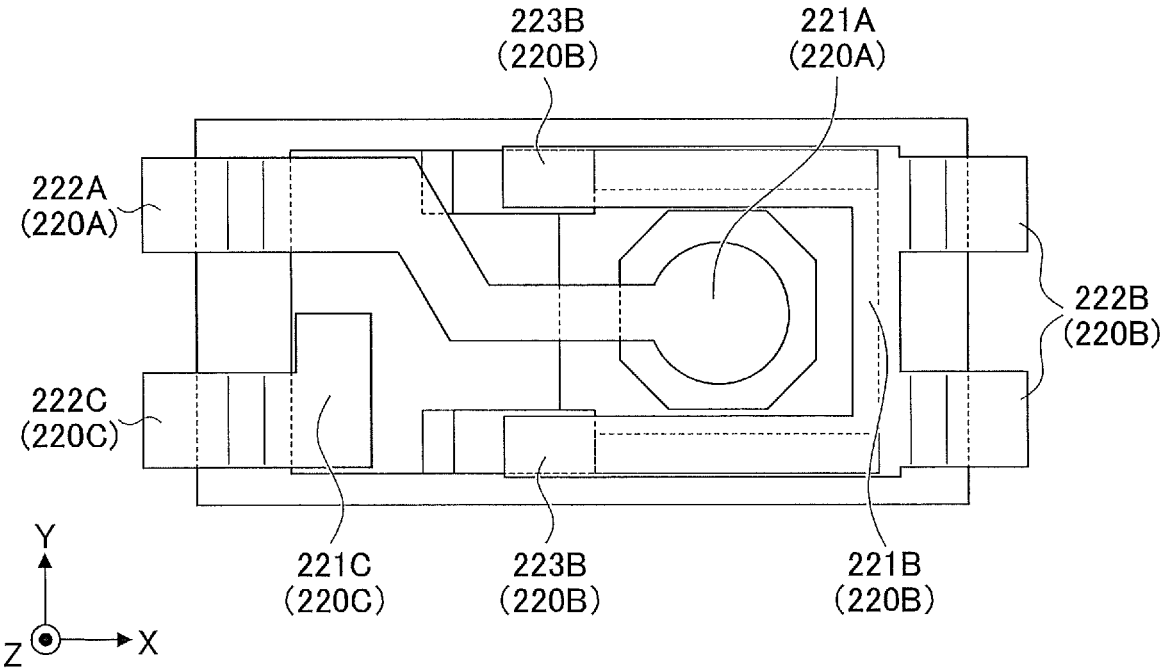
FIG. 10 is a diagram illustrating the structure of metal plates 220A, 220B, and 220C.
Figure 11A:
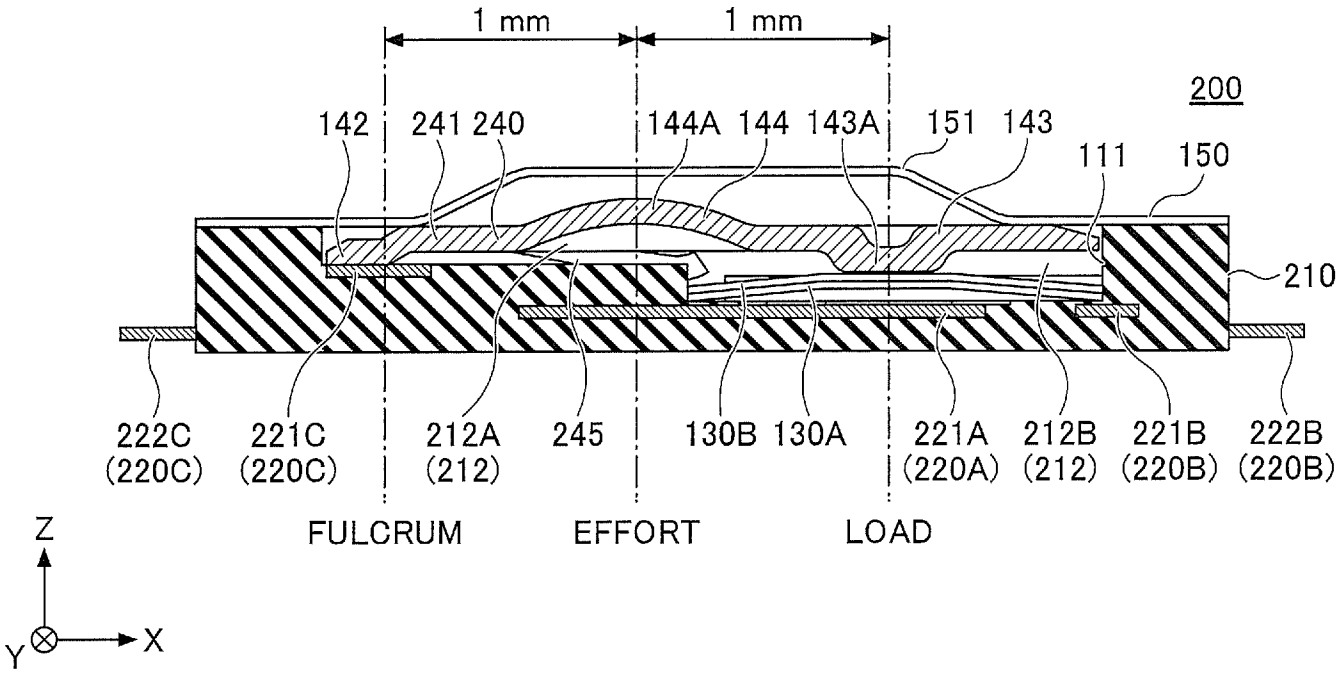
FIG. 11A is a cross-sectional view of the push switch 200 taken through A2-A2 of FIG. 7.
Figure 11B:
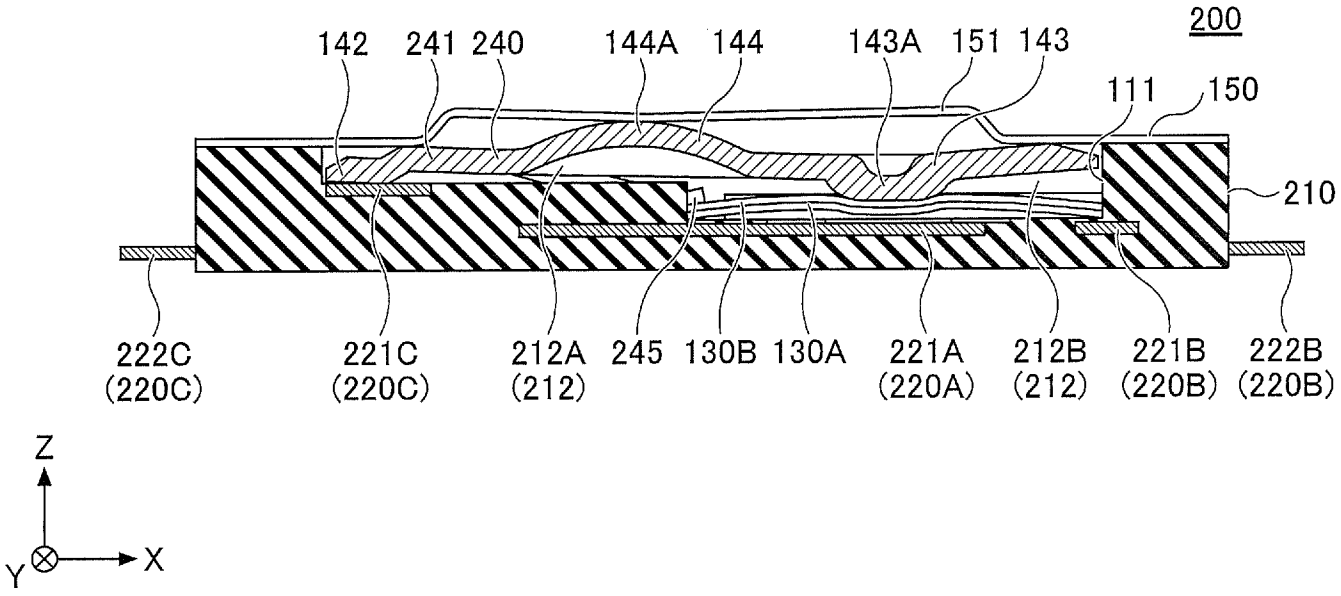
FIG. 11B is a cross-sectional view of the push switch 200 taken through A2-A2 of FIG. 7.
Figure 11C:
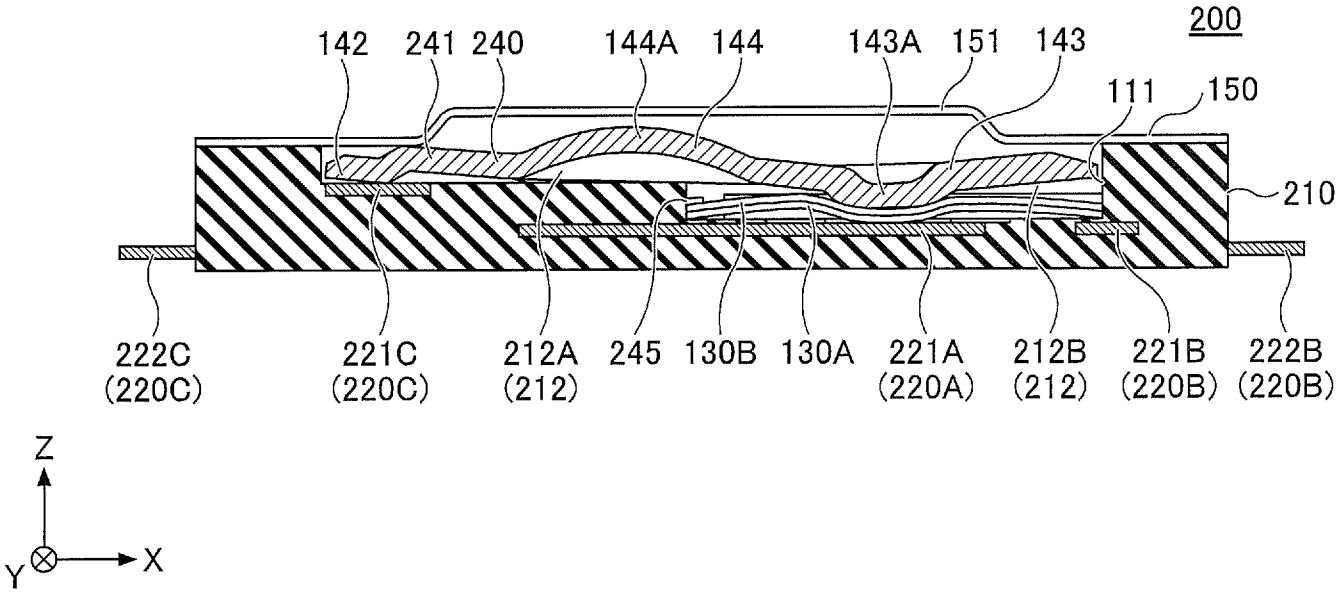
FIG. 11C is a cross-sectional view of the push switch 200 taken through A2-A2 of FIG. 7.
Figure 12A:
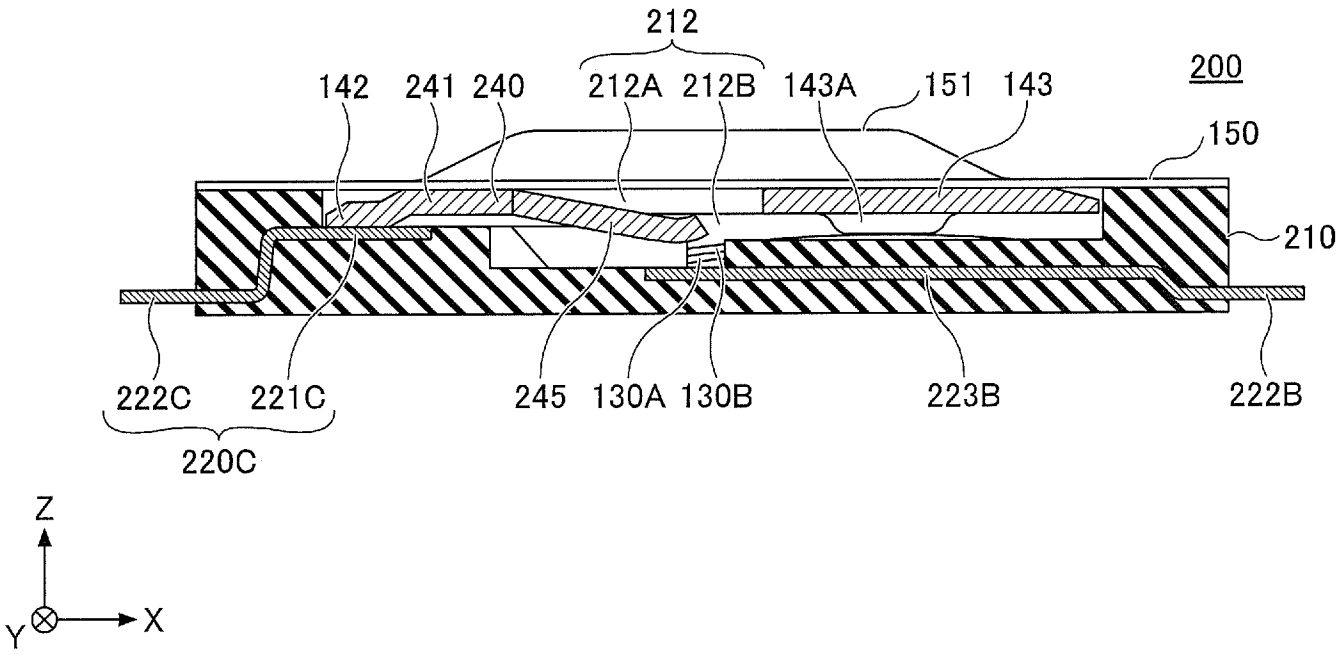
FIG. 12A is a cross-sectional view of the push switch 200 taken through B2-B2 of FIG. 7.
Figure 12B:
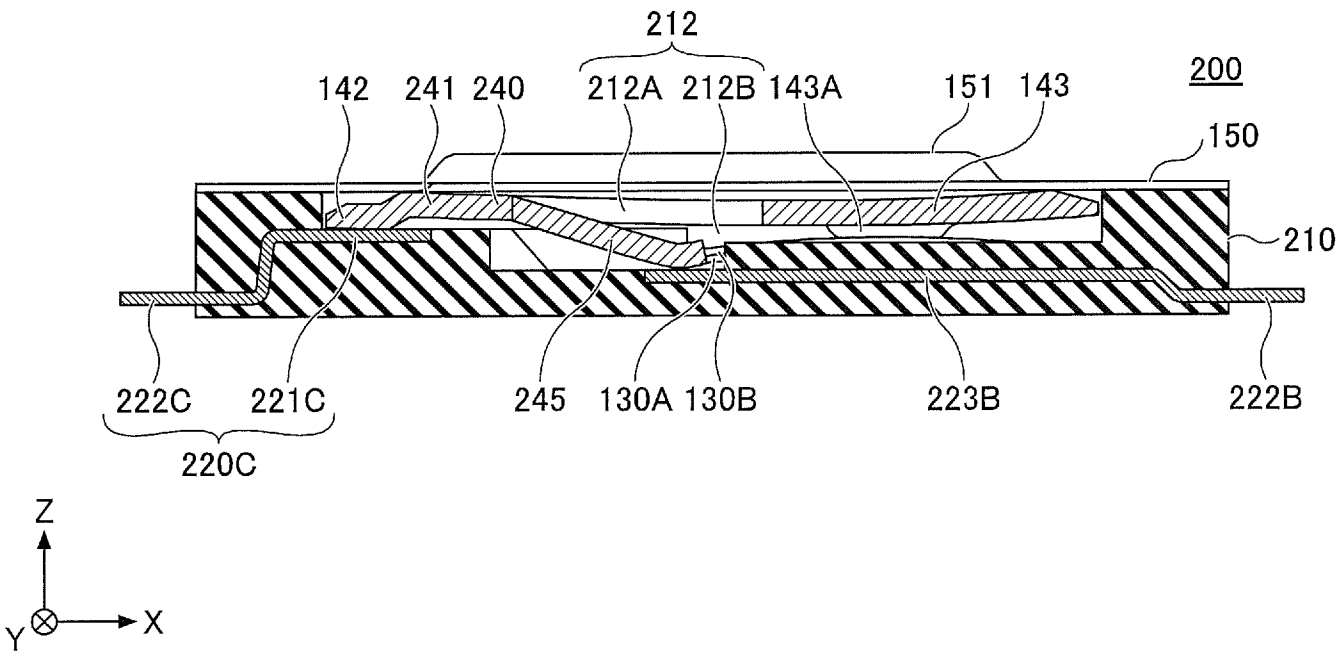
FIG. 12B is a cross-sectional view of the push switch 200 taken through B2-B2 of FIG. 7.
Figure 12C:
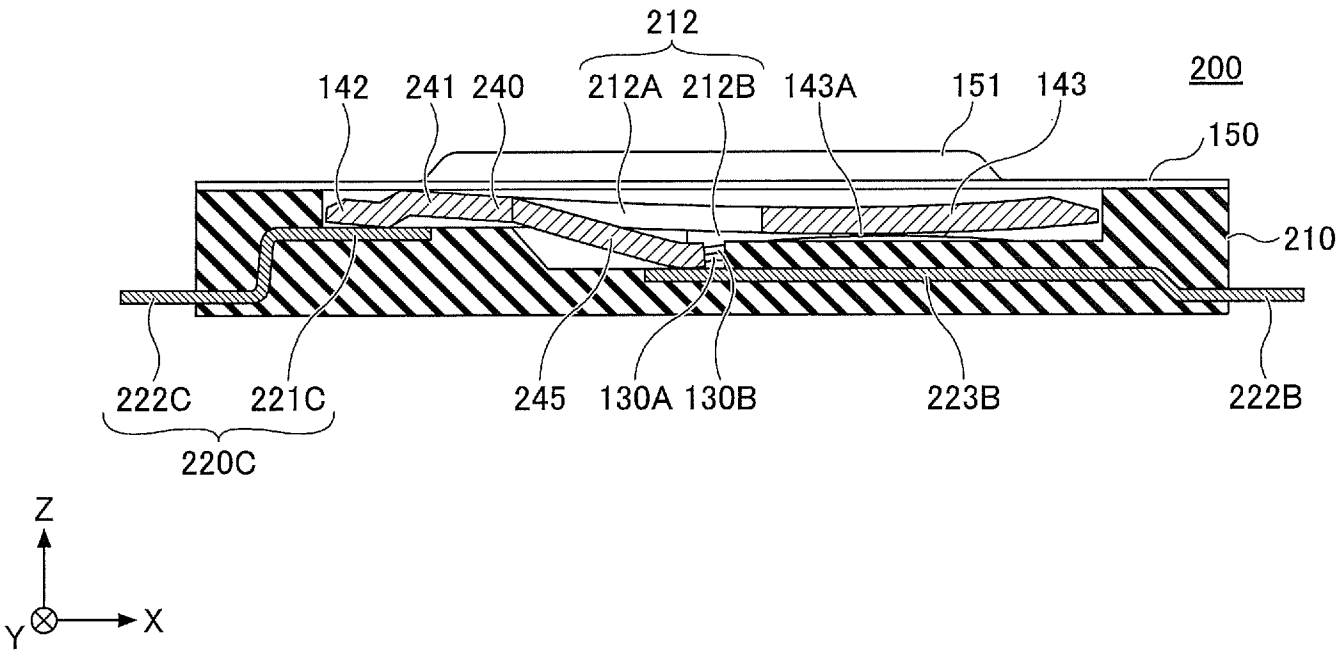
FIG. 12C is a cross-sectional view of the push switch 200 taken through B2-B2 of FIG. 7.

In the following, the pressing member 240 will be described with reference to FIG. 8 and FIG. 9, and the metal plates 220A, 220B, and 220C will be described with reference to FIG. 8 and FIG. 10. FIG. 9 is a diagram illustrating the back side of the pressing member 240. FIG. 10 is a diagram illustrating the structure of the metal plates 220A, 220B, and 220C. FIG. 10 depicts the housing 210 transparently. Further, a cross-sectional structure will be described with reference to FIG. 11A through FIG. 11C and FIG. 12A through FIG. 12C. FIG. 11A through FIG. 11C are cross-sectional views of the push switch 200 taken through A2-A2 of FIG. 7. FIG. 12A through FIG. 12C are cross-sectional views of the push switch 200 taken through B2-B2 of FIG. 7.

The push switch 200 according to the second embodiment has a configuration in which spring contacts 245 are added to the pressing member 140 of the push switch 100 of the first embodiment. The elements similar to those of the push switch 100 of the first embodiment are denoted by the same reference numerals, and a duplicate description thereof will be omitted.

The housing 210 is made of resin, and holds the metal plates 220A, 220B, and 220C. The housing 210 and the metal plates 220A, 220B, and 220C are integrally formed by insert molding. The housing 210 has an opening 111 and a compartment 212 that communicates with the opening 111. The opening 111 is formed on the surface on the positive Z-side of the housing 210.

The compartment 112 extends downward from the opening 111, and includes a compartment 212A on the negative X-side and a compartment 212B on the positive X-side. The casing 212B is deeper than the compartment 212A.

A central fixed contact 221A of the metal plate 220A, and a peripheral fixed contact 221B and pre-sense terminals 223B of the metal plate 220B are disposed at the bottom of the compartment 212B, and are exposed in the compartment 212B. The leaf spring 130B is stacked on the metal contact 130A, and the metal contact 130A and the leaf spring 130B are disposed above the central fixed contact 221A and the peripheral fixed contact 221B within the compartment 212B (see FIG. 11A). The pressing member 240 is disposed on the leaf spring 130B, and is housed over the compartments 212A and 212B. Further, the spring contacts 245 of the pressing member 240 are located above the pre-sense terminals 223B.

The metal plate 220A includes the central fixed contact 221A and a terminal 222A. As compared to the metal plate 120A of the first embodiment, the metal plate 220C is added to the metal plate 220A. Therefore, the shape of the metal plate 220A in plan view differs from the shape of the metal plate 120A of the first embodiment, but the metal plate 220A is functionally the same as the metal plate 120A of the first embodiment. The central fixed contact 221A and the terminal 222A correspond to the central fixed contact 121A and the terminal 122A of the first embodiment, respectively.

The metal plate 220B includes the peripheral fixed contact 221B, terminals 222B, and the pre-sense terminals 223B. The shape of the metal plate 220B differs from the shape of the metal plate 120B of the first embodiment. The metal plate 220B includes the two terminal 222B, and also the two pre-sense terminals 223B are added. The peripheral fixed contact 221B and the terminals 222B are functionally same as the peripheral fixed contact 121B and the terminal 122B of the first embodiment, respectively.

The two terminals 222B extend in the positive X-direction from the respective ends on the positive and negative Y-sides of the peripheral fixed contact 221B. Further, the two pre-sense terminals 223B extend in the negative X-direction from the respective ends on the positive and negative Y-sides of the peripheral fixed contact 221B. The metal plate 220B has an H-shape in plan view.

The metal plate 220C includes a terminal 221C and a terminal 222C. For example, the metal plate 220C may be made of copper. The terminal 221C is exposed to the bottom surface of the compartment 212A, and contacts the lower surface of the fulcrum portion 142 of the pressing member 240 within the compartment 212A. The terminal 222C protrudes to the negative X-side of the housing 210. The terminal 221C is located on the positive Z-side relative to the terminal 222C.

The pressing member 240 is housed over the compartments 212A and 212B of the compartment 212 (see FIG. 11A). The pressing member 240 is an example of the first pressing member. The pressing member 240 includes a body portion 241, a fulcrum portion 142, a load portion 143, an effort portion 144, and the spring contacts 245. The pressing member 240 can function as a lever. For example, the pressing member 240 may be made by processing a metal plate.

The body portion 241 is similar to the body portion 141 of the pressing member 140 of the first embodiment, except that the spring contacts 245 are provided on the positive and negative Y-sides at the center in the X-axis direction of the body portion 241. Further, the body portion 141 has a shape in which the fulcrum portion 142 and the load portion 143 are curved downward with respect to the effort portion 144 such that the load portion 143 can be easily displaced downward.

The spring contacts 245, provided on the positive and negative Y-sides at the center in the X-axis direction of the body portion 241, extend obliquely downward toward the positive X-side and the negative Z-side. The spring contacts 245 are displaceable in the Z-axis direction and exert a restoring force against the displacement in the Z-axis direction. Each of the spring contacts 245 is an example of a first elastic portion.

The operation of the push switch 200 will be described with reference to FIG. 11A through FIG. 11C and FIG. 12A through FIG. 12C. FIG. 11A and FIG. 12A depict a state in which the insulator 150 is not pressed and the push switch 200 is off.

FIG. 11B and FIG. 12B depict a state in which the tips of the spring contacts 245 are connected to the pre-sense terminals 223B of the metal plate 220B upon the insulator 150 being slightly pressed. In this state, the metal contact 130A and the leaf spring 130B are not inverted, and the metal contact 130A does not contact the central fixed contact 221A of the metal plate 220A.

Because the fulcrum portion 142 of the pressing member 240 contacts the terminal 221C of the metal plate 220C, the pre-sense terminals 223B of the metal plate 220B are connected to the terminal 221C of the metal plate 220C through the pressing member 240. That is, the terminals 222B are electrically connected to the terminal 222C.

As described above, the tips of the spring contacts 245 are connected to the pre-sense terminals 223B of the metal plate 220B before the metal contact 130A contacts the central fixed contact 221A of the metal plate 220A. Accordingly, a state in which the insulator 150 is slightly pressed, but the metal contact 130A does not contact the central fixed contact 221A can be detected.

With the above-described configuration, an electronic device that is connected to the terminals 222A, 222B, and 222C of the push switch 200 can detect (pre-sense) a state in which the terminals 222B are electrically connected to the terminal 222C upon the insulator 150 being slightly pressed, but the terminal 222A is not electrically connected to the terminal 222C (that is, a state before the metal contact 130A contacts the central fixed contact 221A).

FIG. 11C and FIG. 12C depict a state in which the metal contact 130A and the leaf spring 130B are inverted and the metal contact 130A contacts the central fixed contact 221A of the metal plate 220A upon the insulator 150 being further pressed. In this state, the tips of the spring contacts 245 remain connected to the pre-sense terminals 223B of the metal plate 220B, and the terminal 222A is electrically connected to the terminal 222C.

Accordingly, the push switch 200 according to the present embodiment can be brought into a state in which the terminals 222B are electrically connected to the terminal 222C upon the insulator 150 being slightly pressed as illustrated in FIG. 11B and FIG. 12B, and a state in which the terminal 222A is electrically connected to the terminal 222C upon the insulator 150 being further pressed.

Figure 13:
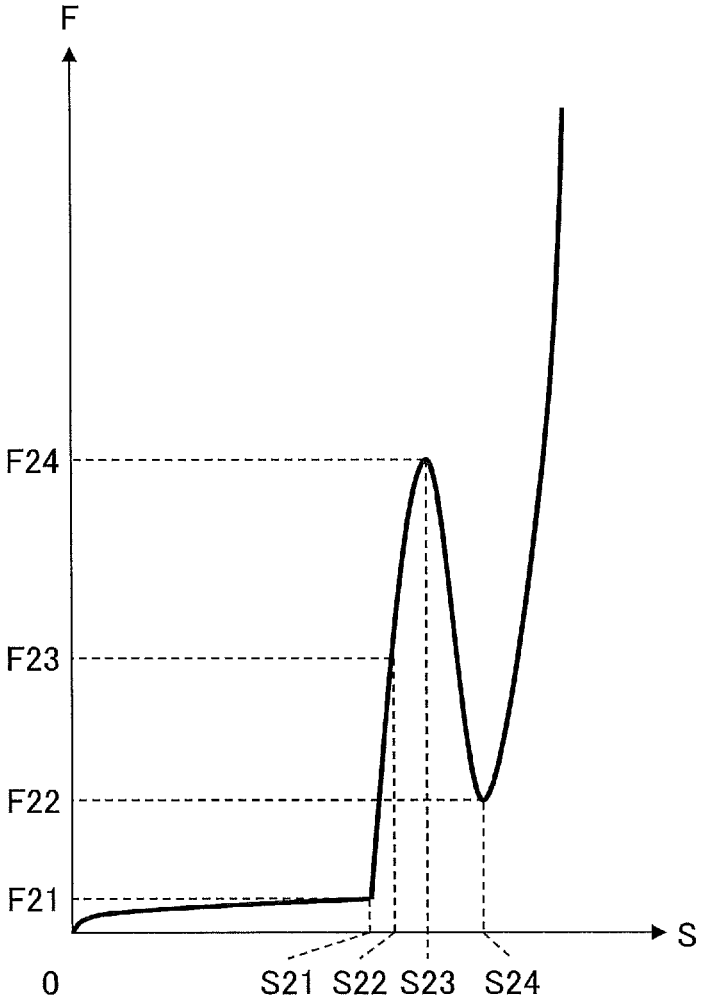
FIG. 13 is a graph indicating force-stroke (FS) characteristics of the push switch 200.

FIG. 13 is a graph indicating force-stroke (FS) characteristics of the push switch 200. A section from a zero-stroke position to S21 in FIG. 13 is the same as the section from the zero-stroke position to S1 of the push switch 100 according to the first embodiment (see FIG. 6). That is, S21 is equal to the stroke S1, and operating load F21 is equal to F1.

Upon the stroke reaching S22 after passing S21, the spring contacts 245 contact the pre-sense terminals 223B, and the terminals 222B are electrically connected to the terminal 222C. F23 indicates the operating load at this time.

Upon the insulator 150 being further pressed, the pressing member 240 presses the metal contact 130A and the leaf spring 130B. Upon the stroke reaching S23, the operating load becomes F24 (a local maximum) and the metal contact 130A and the leaf spring 130B are inverted. At this time, the operating load starts to rapidly decrease, and thus a clicking sensation is provided to the user's finger. Pressing the insulator 150 further causes the stroke to reach S24 and the operating load to be decreased to F22. At this time, the metal contact 130A contacts the central fixed contact 221A, thereby causing the push switch 100 to be turned on.

Note that the stroke S22 can be adjusted by adjusting the amount of displacement of the spring contacts 245, and the operating load F23 can be adjusted by adjusting the elastic force of the spring contacts 245.

Accordingly, in the second embodiment, similar to the first embodiment, the short-stroke push switch 200 having electrical stability can be provided. Further, a clicking sensation during operation can be increased, thus improving an operating sensation.

Further, with the spring contacts 245, the push switch 200 that can be brought into the above-described two states can be provided. In addition to the above-described effects, the push switch 200 according to the second embodiment can exhibit any effects similar to those of the push switch 100 of the first embodiment. In addition, variations similar to those of the push switch 100 of the first embodiment can be made to the push switch 200 according to the second embodiment.

Note that the number of spring contacts 245 may be one, or may be three or more.

Third Embodiment

Figure 14:
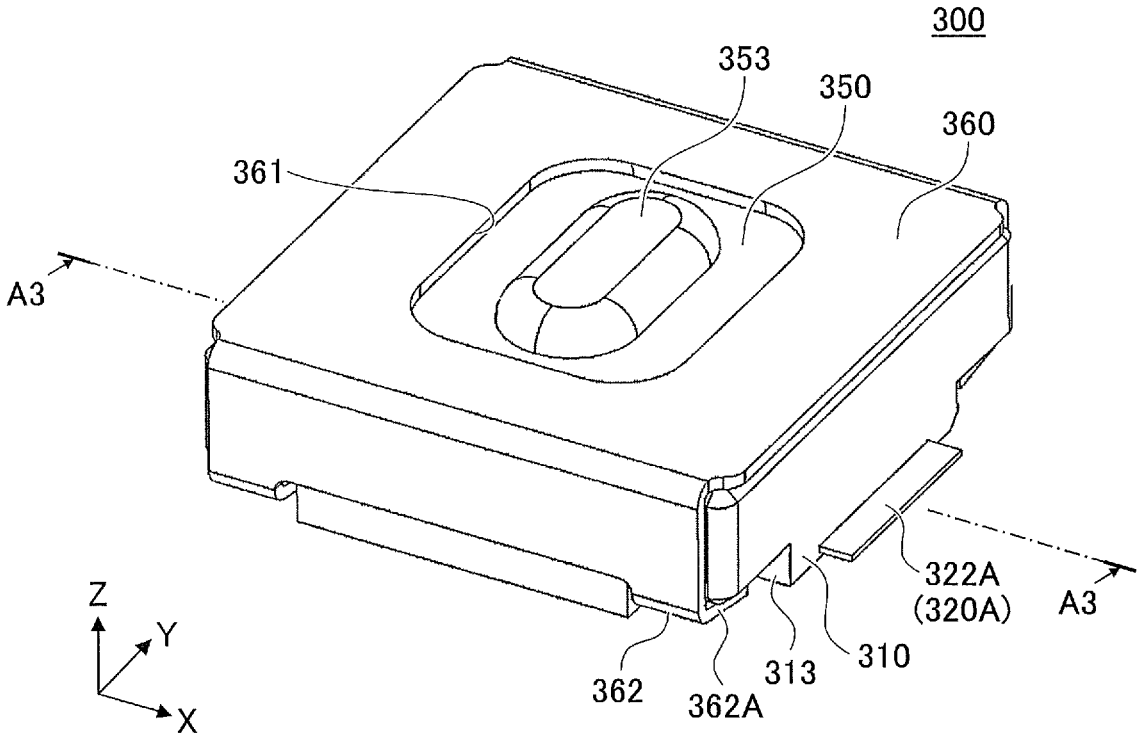
FIG. 14 is a perspective view of a push switch 300 according to a third embodiment.
Figure 15:
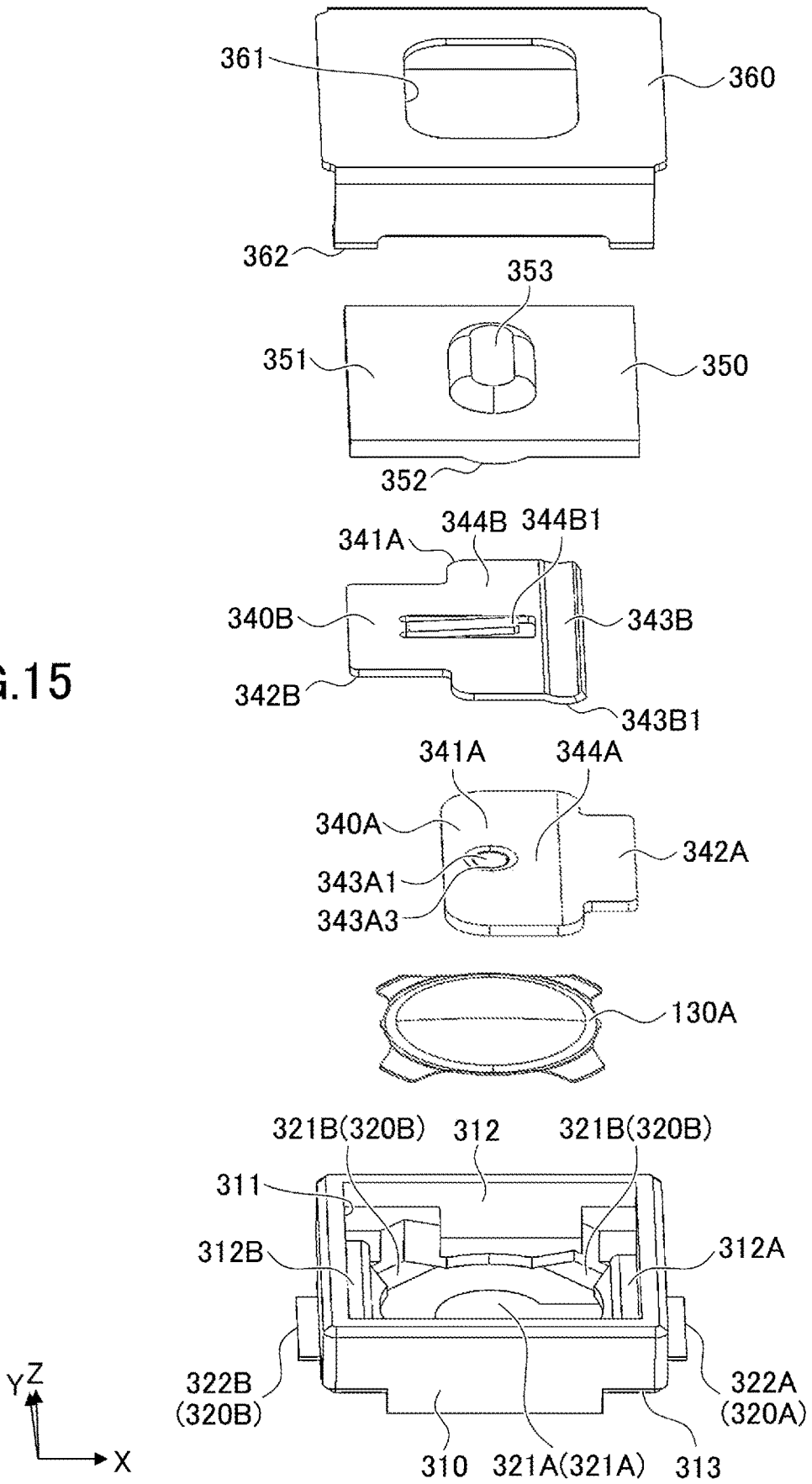
FIG. 15 is an exploded view of the push switch 300.
Figure 16A:
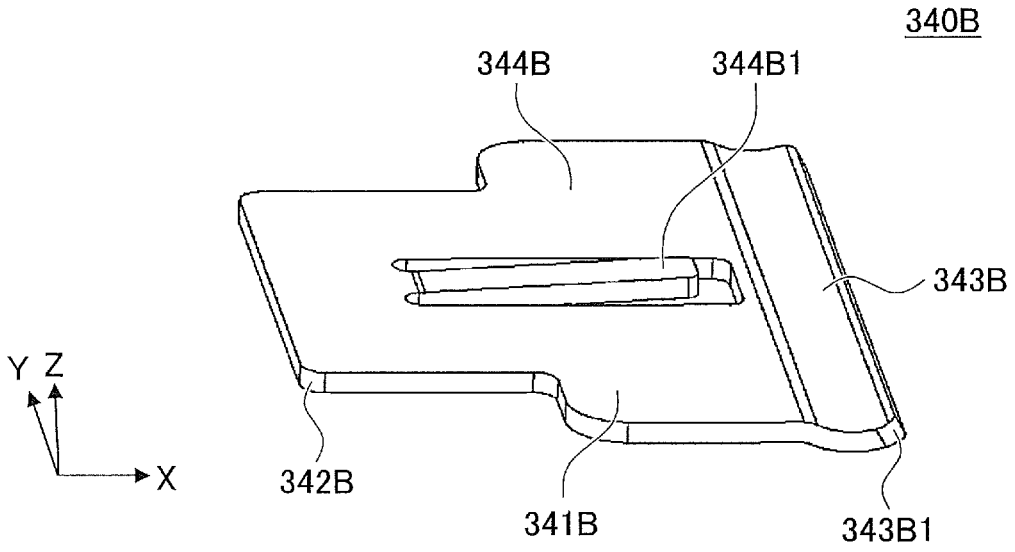
FIG. 16A is a diagram illustrating a pressing member 340B.
Figure 16B:
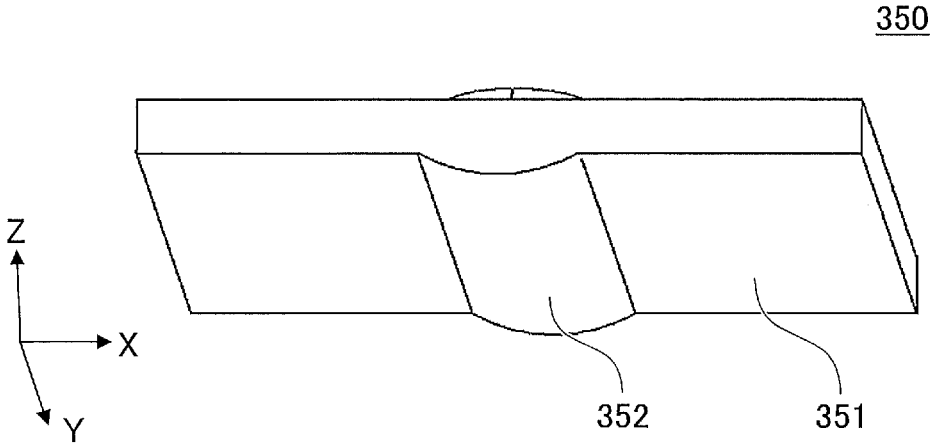
FIG. 16B is a diagram illustrating a stem 350.

FIG. 14 is a perspective view of a push switch 300 according to a third embodiment. FIG. 15 is an exploded view of the push switch 300.

Figure 17:
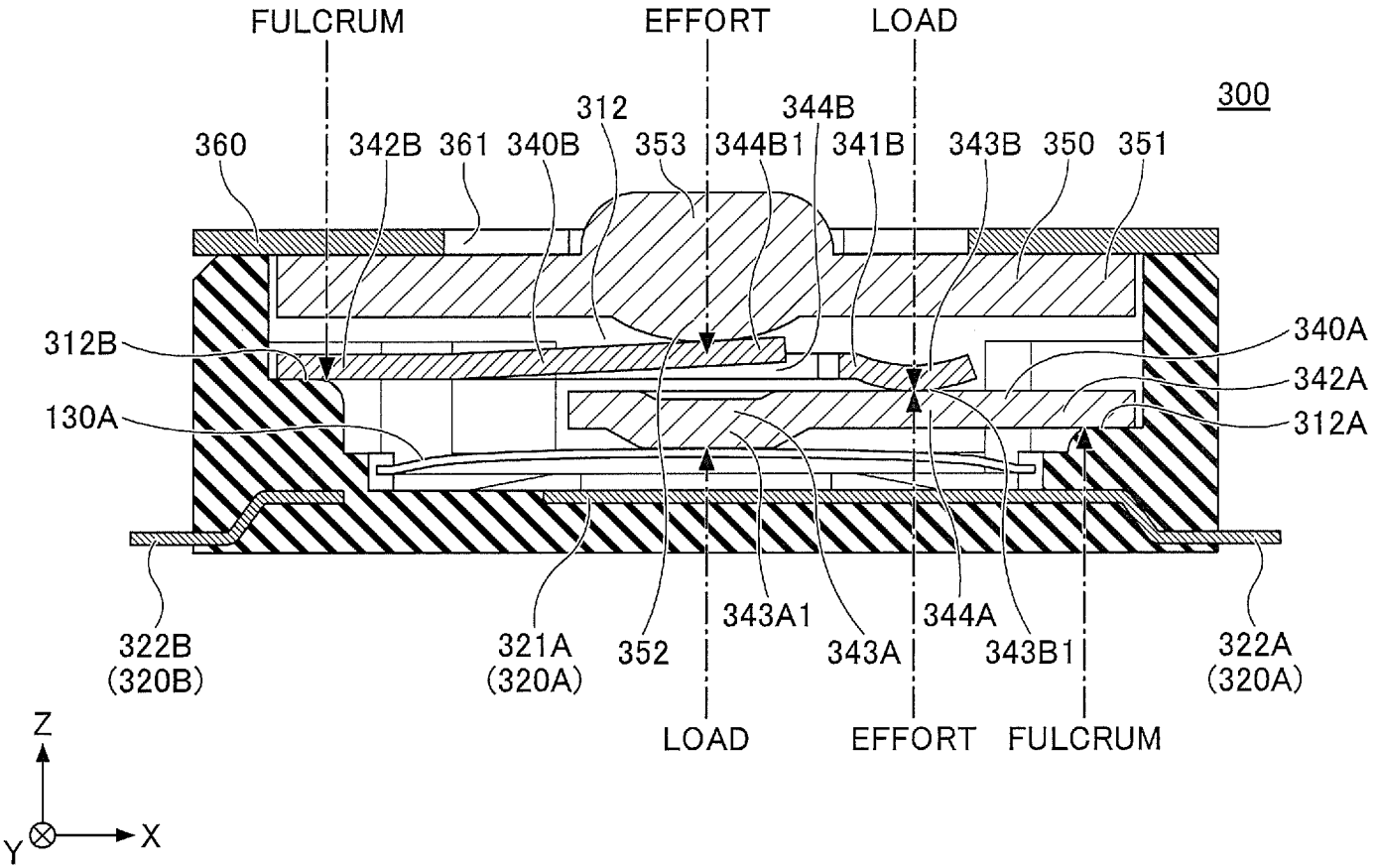
FIG. 17 is a cross-sectional view of the push switch 300 taken through A3-A3 of FIG. 14.
Figure 18:
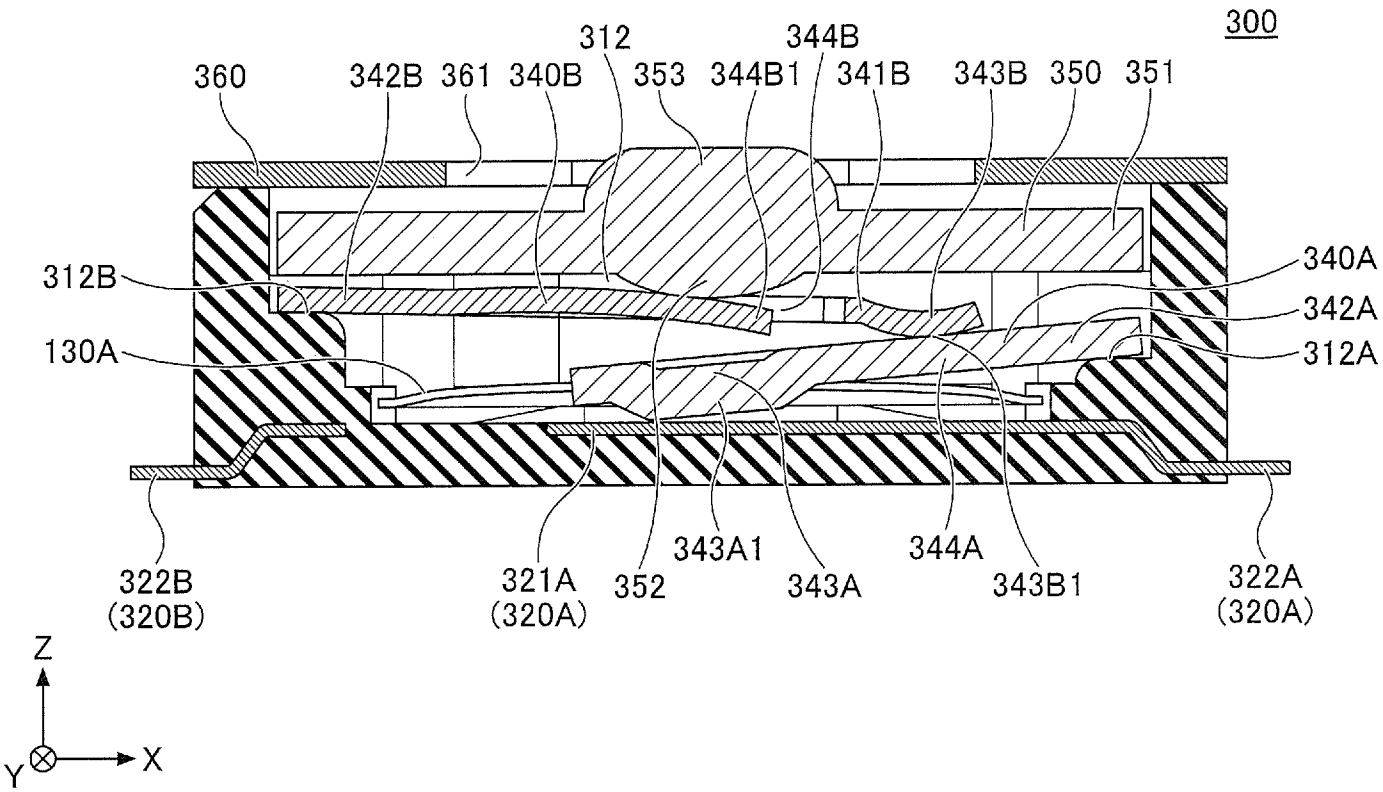
FIG. 18 is a cross-sectional view of the push switch 300 taken through A3-A3 of FIG. 14.

The push switch 300 includes a housing 310, metal plates 320A and 320B, a metal contact 130A, pressing members 340A and 340B, a stem 350, and a frame 360. In the following, the pressing member 340B and the stem 350 will be described with reference to FIG. 14, FIG. 15, and FIGS. 16A and 16B. Further, the cross-sectional structure and the operation of the push switch 300 will be described with reference to FIG. 17, and FIG. 18. FIG. 17 and FIG. 18 are cross-sectional views of the push switch 300 taken through A3-A3 of FIG. 14.

Upon the stem 350 being pressed down, the metal contact 130A contacts the metal plate 320A, thereby causing the push switch 300 to be on (in an electrically connected state). A stroke for pressing the stem 350 in order to cause the metal contact 130A to contact the metal plate 320A is 0.1 mm, which is very short. Further, an operating load required to press the stem 350 is 9 N, for example. The metal contact 130A is greater in size than those of the first embodiment and the second embodiment, and the stroke of the metal contact 130A itself is 0.3 mm. That is, the stroke for pressing the stem 350 is reduced to one-third of the stroke of the metal contact 130A itself.

The push switch 300 is configured such that the stroke of the push switch 300 is reduced while increasing the operating load.

The housing 310 is made of resin, and holds the metal plates 320A and 320B. The housing 310 and the metal plates 320A and 320B are integrally formed by insert molding. The housing 310 has an opening 311 and a compartment 312 that communicates with the opening 311. The opening 311 is formed on the surface on the positive Z-side of the housing 310.

The compartment 312 extends downward from the opening 311, and includes a support portion 312A and a support portion 312B. The support portion 312A supports a fulcrum portion 342A of the pressing member 340A, and the support portion 312B supports a fulcrum portion 342B of the pressing member 340B. The support portions 312A and 312B are portions that protrude inward from the wall of the housing 310. The support portion 312A is on the positive X-side, and the support portion 312B is on the negative X-side of the housing 310. The support portion 312A is located at a position lower than the support portion 312B.

A central fixed contact 321A of the metal plate 320A and a peripheral fixed contact 321B of the metal plate 320B are disposed at the bottom of the compartment 312, and are exposed in the compartment 312. The central fixed contact 321A is disposed at the center of the bottom of the compartment 312, and portions of the peripheral fixed contact 321B are disposed at the four corners of the bottom portion of the compartment 312. The metal contact 130A and the pressing members 340A and 340B are disposed above the central fixed contact 321A and the peripheral fixed contact 321B within the compartment 312.

The metal plate 320A includes the central fixed contact 321A and a terminal 322A. For example, the metal plate 320A may be made of copper. The central fixed contact 321A does not contact the metal contact 130A when the stem 350 is not pressed down (see FIG. 17), and contacts the metal contact 130A when the stem 350 is being pressed down (see FIG. 18). The terminal 322A protrudes to the positive X-side of the housing 110.

The metal plate 320B includes the peripheral fixed contact 321B and a terminal 322B. For example, the metal plate 320B may be made of copper. The peripheral fixed contact 321B has a U-shape and is disposed in the surroundings of the central fixed contact 321A in plan view. The portions of the peripheral fixed contact 321B are disposed at the four corners of the bottom of the compartment 312 while being exposed in the compartment 312. The peripheral fixed contact 321B contacts end portions of the metal contact 130A when the stem 350 is not pressed down (see FIG. 17), and contacts the metal contact 130A also when the stem 350 is being pressed down (see FIG. 18). This relationship between the peripheral fixed contact 321B and the metal contact 130A is the same as the relationship between the peripheral fixed contact 121B and the metal contact 130A of the first embodiment. The terminal 322B protrudes to the negative X-side of the housing 310.

The pressing member 340A is housed in the compartment 312 (see FIG. 17). The pressing member 340A is an example of the first pressing member. The pressing member 340A is a metal member having a flat plate shape (see FIGS. 15, 16, and 18). The pressing member 340A includes a body portion 341, the fulcrum portion 342A (an example of the first fulcrum portion), a load portion 343A (an example of the first load portion), and an effort portion 344A (an example of the first effort portion). The pressing member 340A can function as a lever, and the fulcrum portion 342A, the load portion 343A, and the effort portion 344A can function as the fulcrum, load, and effort of a lever. For example, the pressing member 340A may be made by processing a metal plate.

In order for the pressing member 340A to function as a lever, the pressing member 340A needs to have low deflection and relatively high stiffness. For this reason, the pressing member 340A is composed of metal, and is relatively wide in the Y-axis direction and relatively thick in the Z-axis direction.

The fulcrum portion 342A is disposed on the positive X-side and is supported by the support portion 312A of the compartment 312. The width in the Y-axis direction of the fulcrum portion 342A is sufficiently large. Therefore, the fulcrum portion 342A is not readily tilted in the Y-axis direction when the pressing member 340A is moved, thereby allowing a force to be efficiently transmitted to the metal contact 130A.

The load portion 343A includes a projection 343A1 (an example of the first projection). The projection 343A1 is provided on the negative X-side and is configured to press the metal contact 130A. The projection 343A1 has a truncated cone shape and has a flat lower surface, and further, the projection 343A1 has a circular shape in plan view. The projection 343A1 is similar to the projection 143A of the first embodiment.

The pressing member 340A utilizes the principle of leverage to cause the load portion 343A to be pressed down. Upon the load portion 343A being pressed, the projection 343A1 presses the metal contact 130A down. As a result, the metal contact 130A is inverted and contacts the central fixed contact 321A.

The effort portion 344A is disposed between the fulcrum portion 342A and the load portion 343A. Upon the stem 350 being pressed down, a load portion 343B of the pressing member 340B presses the effort portion 344A down. In this state, the force is applied to the effort of the pressing member 340A that utilizes the principle of leverage.

The pressing member 340B is stacked on the pressing member 340A, and in this state, the pressing member 340B is housed in the compartment 312 (see FIG. 17). The pressing member 340B is an example of a second pressing member. The pressing member 340B is a metal member having a flat plate shape (see FIGS. 15, 16A, 16B, 17, and 18). The pressing member 340B includes the body portion 341, the fulcrum portion 342B (an example of a second fulcrum portion), the load portion 343B (an example of a second load portion), and an effort portion 344B (an example of a second effort portion). The pressing member 340B utilizes the principle of leverage, and the fulcrum portion 342B, the load portion 343B, and the effort portion 344B can function as the fulcrum, load, and effort of a lever. For example, the pressing member 340B may be made by processing a metal plate.

In order for the pressing member 340B to utilize the principle of leverage, the pressing member 340B needs to have low deflection and relatively high stiffness. For this reason, the pressing member 140 is composed of metal, and is relatively wide in the Y-axis direction and relatively thick in the Z-axis direction.

The fulcrum portion 342B is disposed on the negative X-side and is supported by the support portion 312B of the compartment 312. The width in the Y-axis direction of the fulcrum portion 342B is sufficiently large. Therefore, the fulcrum portion 342B is not readily tilted in the Y-axis direction when the pressing member 340A is moved, thereby allowing a force to be efficiently transmitted to the metal contact 130A.

The load portion 343B is disposed on the positive X-side, and includes a projection 343B1 (an example of a second projection) configured to press the effort portion 344A. The projection 343B1 extends from the end on the negative Y-side to the end on the positive Y-side of the load portion 343B.

The pressing member 340B utilizes the principle of leverage to cause the load portion 343B to be pressed down. Upon the load portion 343B being pressed down, the projection 343B1 contacts the upper surface of the effort portion 344A of the pressing member 340A and presses the effort portion 344A of the pressing member 340A down.

The effort portion 344B is disposed between the fulcrum portion 342B and the load portion 343B. The effort portion 344B includes a spring portion 344B1. The negative X-side of the spring portion 344B1 is connected to the body portion 341, and the spring portion 344B1 extends obliquely upward with respect to the body portion 341. When the stem 350 is not pressed down, the spring portion 344B1 contacts a projection 352 of the stem 350 such that the stem 350 is biased upward and is pressed against the frame 360. The spring portion 344B1 is disposed to apply pretension.

As illustrated in FIG. 18, upon the stem 350 being pressed down, the spring portion 344B1 is pressed by the projection 352 and elastically deforms. As a result, the effort portion 344B is pressed down. In this state, the force is applied to the effort of the pressing member 340B that utilizes the principle of leverage.

The stem 350 includes a plate-shaped body portion 351, the projection 352, and a projection 353. The stem 350 is made of resin. The projection 352 is formed on the lower surface of the body portion 351 and protrudes downward. The projection 352 extends from the end on the negative-Y side to the end on the positive-Y side of the body portion 351. As illustrated in FIG. 17, when the stem 350 is not pressed down, the projection 352 contacts the spring portion 344B1 of the pressing member 340B.

The projection 353 is formed on the upper surface of the body portion 351, and protrudes upward. The projection 353 has an elliptical shape in plan view and has a flat upper surface. The projection 353 is exposed from an opening 361 of the frame 360.

The frame 360 is made of metal. The frame 360 includes the opening 361 on the upper surface thereof, and includes side walls 362 on both sides in the Y-axis direction thereof. Engagement portions 362A that bend inward (in the Y-axis direction) are formed on the lower ends of the side walls 362. The engagement portions 362A are located at the four lower corners of the frame 360.

The metal plates 320A and 320B, the metal contact 130A, and the pressing members 340A and 340B are housed in the compartment 312 of the housing 310 with the stem 350 being stacked on the pressing member 340B. In this state, the engagement portions 362A of the frame 360 engage with recesses 313 located at the four corners of the housing 310. Accordingly, as illustrated in FIG. 14, the frame 360 holds the housing 310, the metal plates 320A and 320B, the metal contact 130A, the pressing members 340A and 340B, and the stem 350.

With the above-described configuration, the housing 310, the metal plates 320A and 320B, the metal contact 130A, the pressing members 340A and 340B, and the stem 350 are held without looseness.

Figure 19:
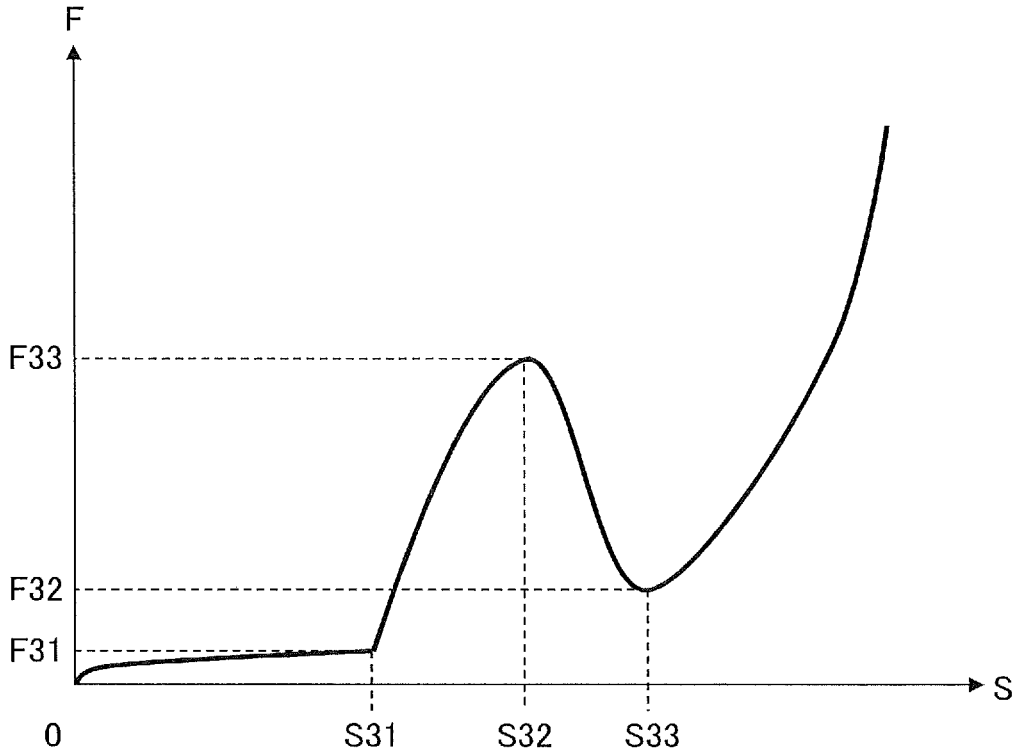
FIG. 19 is a graph indicating force-stroke (FS) characteristics of the push switch 300.

FIG. 19 is a graph indicating force-stroke (FS) characteristics of the push switch 300. The horizontal axis represents a stroke (S) for pressing the stem 350 down, and the vertical axis represents a force (F) required to press the stem 350 down. The force (F) corresponds to the operating load.

As illustrated in FIG. 19, when the stem 350 is pressed from a zero-stroke position, the operating load gradually increases until reaching S31. During this time, the operating load is very small. This indicates that the operating load required to press the spring portion 344B1 of the pressing member 340B is very small.

S31 is 0.1 mm. The push switch 300 may include a button on the stem 350. The button may be a push button switch used in a vehicle, a push-button switch used in an electronic device, or any button that is actually pressed. For example, in the case of a product that is easily subjected to vibrations, such as a portable device, if there is a gap between a stem and a button, a vibration applied to the product would be transmitted to the button and as a result, noise would be generated. In such a case, the noise may be reduced by pressing the button against another component while the product is not in operation. For example, the button may be attached to the stem while slightly pressing (pre-tensioning) the stem so as to avoid a gap between the button and the stem. In this state, the stem is being pressed by the stroke S31 or less. In this case, when the button is pressed, the stroke may start from S31.

Upon the stroke reaching S31, the stem 350 contacts the effort portion 344B. Upon the stroke exceeding S31, the pressing member 340B presses the pressing member 340A, and the pressing member 340A presses the metal contact 130A. Upon the stroke reaching S32, the operating load becomes F33 (a local maximum), and the metal contact 130A is inverted. Pressing the stem 350 further causes the stroke to reach S33 and the operating load to be decreased to F32. At this time, as illustrated in FIG. 18, the metal contact 130A contacts the central fixed contact 321A, thereby causing the push switch 300 to be turned on.

The push switch 300 as described above includes the pressing members 340A and 340B functioning as two levers. Upon the stem 350 being pressed down, the load portion 343B of the pressing member 340B presses the effort portion 344A of the pressing member 340A down, and the load portion 343A of the pressing member 340A presses the metal contact 130A. Then, the metal contact 130A contacts the central fixed contact 321A, thereby causing the central fixed contact 321A to be electrically connected to the peripheral fixed contact 321B. In this state, the push switch 300 is on.

As described above, the push switch 300 includes the pressing members 340A and 340B functioning as the two levers. Accordingly, the stroke of the push switch 300 can be reduced while increasing the operating load.

Accordingly, in the third embodiment, the stroke required for the push switch 300 can be reduced without reducing the operation stroke of the metal contact 130A. Therefore, the short-stroke push switch 300 having electrical stability can be provided. Further, a clicking sensation during operation can be increased, thus improving an operating sensation.

Further, by utilizing the two levers (pressing members 340A and 340B), the operating load required for the push switch 300 can be readily obtained if a metal contact with a low operating load is used. In general, a metal contact with a high operating load tends to have a longer operating life than a metal contact with a low operating load. That is, the operating life of the push switch 300 can be extended.

Further, in the third embodiment a predetermined operating load can be obtained by utilizing the two levers (pressing members 340A and 340B). Therefore, the metal contact 130A can be used alone without the leaf spring 130B. That is, the number of stacked parts may be reduced (that is, the leaf spring 130B is not required to be provided).

Further, the pressing members 340A and 340B can be made by stamping metal plates. Therefore, the components such as the fulcrum portion 342A, the load portion 343A, and the effort portion 344A can be readily formed.

Figure 20:
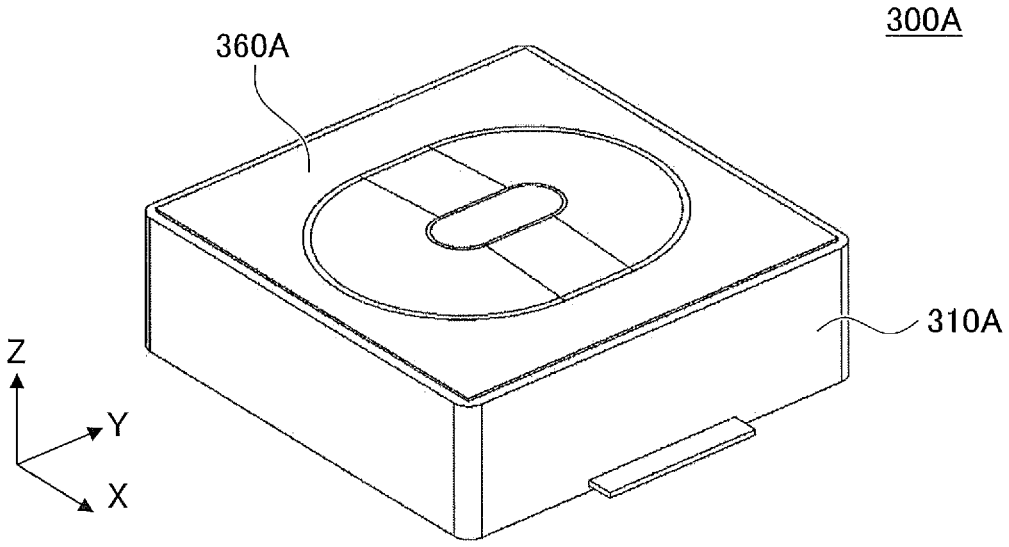
FIG. 20 is a perspective view of a push switch 300A according to a variation of the third embodiment.

In the above-described embodiment, an example in which the push switch 300 includes the frame 360 has been described. However, the frame 360 is not required to be included. A push switch 300A illustrated in FIG. 20 does not include the frame 360. In the push switch 300A, the metal plates 320A and 320B, the metal contact 130A, the pressing members 340A and 340B, and the stem 350 (see FIG. 14) are housed in a housing 310A, and in this state, an insulator 360A is attached to the upper surface of the housing 310A. The insulator 360A is similar to the insulator 150 (see FIG. 1) of the first embodiment.

The metal plates 320A and 320B, the metal contact 130A, the pressing members 340A and 340B, and the stem 350 are housed in the housing 310A, and in this state, the insulator 360A is attached to the upper surface of the housing 310A so as to prevent looseness. Similar to the push switch 300, with the above-described configuration, the stroke of the push switch 300 can be reduced while increasing the operating load.

Although the push switches according to the embodiments have been described above, the present invention is not limited to the particulars of the above-described embodiments. Variations and modifications may be made without departing from the scope of the subject matter recited in the claims.

What is claimed is:

1. A push switch comprising:

a housing including an opening and a compartment that communicates with the opening;

a fixed contact member attached to the housing and disposed within the compartment;

a movable contact member disposed closer to the opening than the fixed contact member within the compartment and including a dome, the dome protruding toward the opening and being invertible; and a first pressing member disposed closer to the opening than the movable contact member within the compartment and including a first fulcrum portion, a first load portion, and a first effort portion, the first fulcrum portion being disposed on one side of the first pressing member to contact the housing, the first load portion being disposed on another side of the first pressing member to press the movable contact member, and the first effort portion being disposed between the first fulcrum portion and the first load portion, wherein upon the first effort portion being pressed through the opening in a direction that is same as an inverting direction of the movable contact member, the first load portion, presses, and inverts the dome of the movable contact member, and the movable contact member contacts the fixed contact member, wherein the first pressing member includes a first elastic portion that protrudes toward a side opposite to the opening, the fixed contact member includes a first fixed contact configured to be contacted with and separated from the movable contact member, and includes a second fixed contact configured to be contacted with and separated from the first elastic portion, and upon the first effort portion being pressed through the opening, the first elastic portion contacts the second fixed contact, and subsequently, the first load portion presses and inverts the dome of the movable contact member, and the movable contact member contacts the first fixed contact.

2. The push switch according to claim 1, wherein the first load portion includes a first projection configured to press the movable contact member.

3. The push switch according to claim 1, wherein the first fulcrum portion protrudes toward a side opposite to the opening with respect to the first effort portion.

4. The push switch according to claim 1, wherein the first fulcrum portion has, a rib shape that has a predetermined length in a first direction, the first direction being perpendicular to a second direction in which the first fulcrum portion, the first load portion, and the first effort portion are arranged.

5. The push switch according to claim 1, wherein the first pressing member is composed of a metal plate that is electrically conductive.

6. The push switch according to claim 1, further comprising an insulator disposed to cover the opening.

7. The push switch according to claim 6, wherein the insulator includes a protrusion that is disposed at a position overlapping with the first effort portion in plan view, that protrudes in a direction away from the housing, and that is deflectable and deformable so as to, contact the first effort portion, and wherein the protrusion is spaced apart from the first effort portion in a state in which the protrusion is not deflected and deformed.

8. The push switch according to claim 1, wherein the movable contact member includes a metal contact and a leaf spring that is directly stacked on the metal contact.

* * * * *